US005337794A

United States Patent [19]

Nishiyama et al.

[11] Patent Number: 5,337,794

[45] Date of Patent: Aug. 16, 1994

[54] POWDER FILLING APPARATUS AND A METHOD FOR FILLING A CONTAINER WITH POWDER

[75] Inventors: Shigeru Nishiyama; Yasuhiro Hayashi, both of Osaka, Japan

[73] Assignee: Mita Industrial Co., Ltd., Osaka, Japan

[21] Appl. No.: 20,329

[22] Filed: Feb. 18, 1993

[51] Int. Cl.[5] ..... B65B 3/14

[52] U.S. Cl. ..... 141/144; 141/149; 141/65; 141/51; 141/264; 141/253; 141/275

[58] Field of Search ..... 141/1, 5, 7, 8, 11, 141/12, 47–51, 62, 65, 67, 71–74, 77–80, 144–150, 152, 156, 177, 275–278, 283, 251–253, 255, 258, 260, 263, 264, 266

[56] References Cited

U.S. PATENT DOCUMENTS

| | | | |
|---|---|---|---|
| 915,847 | 3/1909 | Frye | 141/253 X |
| 2,613,864 | 10/1952 | Carter | 141/147 X |
| 2,684,803 | 7/1954 | Birkland et al. | 141/150 X |
| 2,718,345 | 9/1955 | Howard | 141/51 X |
| 2,780,247 | 2/1957 | Claassen, Jr. | 141/51 X |

FOREIGN PATENT DOCUMENTS

| | | | |
|---|---|---|---|
| 3134593 | 11/1978 | Japan | 141/156 |
| 1111601 | 4/1989 | Japan | 141/65 |
| 1-124503 | 5/1989 | Japan | 141/71 |
| 1124501 | 5/1989 | Japan | 141/65 |
| 3240601 | 10/1991 | Japan | 141/65 |

*Primary Examiner*—J. Casimer Jacyna

*Attorney, Agent, or Firm*—Renner, Otto, Boisselle & Sklar

[57] ABSTRACT

A powder filling apparatus for filling a container with powder is provided. In the powder filling apparatus, a bottle is carried into a plurality of work units moving around successively. While the work units move to work stations disposed in a circumferential direction successively, the bottle is filled with powder by equally evacuating the inside and the outside of the container and dropping powder into the container simultaneously with raising the pressure outside the container. The bottle filled with powder is then taken out from the work units successively while the work units move around.

11 Claims, 12 Drawing Sheets

POWDER FILLING APPARATUS AND A METHOD FOR FILLING A CONTAINER WITH POWDER

BACKGROUND OF THE INVENTION

1. Field of the Invention

The present invention relates to a powder filling apparatus capable of filling a container with powder, such as toner used for an image forming apparatus, with high density and at high speed, and a method for filling a container with powder. The present invention also relates to a cleaner used for removing powder attached to a nozzle of the powder filling apparatus through which the powder drops.

2. Description of the Related Art:

Toner used for an image forming apparatus such as an electrophotographic copying machine is normally contained in a bottle or other containers having a cylindrical or rectangular parallelepiped shape for transportation and storage. Conventionally, such a container is filled with toner by placing it under a toner feed device to receive toner dropping by free-fall.

However, because air is present in the container, the drop speed of toner is reduced, and the toner accumulated in the container is mixed with the air. As a result, the bulk density of the toner in the container is reduced, and thus it is not possible to feed a required amount of toner to the container at one time by free-fall. Instead, in practice, about half the amount of toner required for filling the container is first fed by gravity, for example. Then, after an elapse of a predetermined time period during which the toner in the container has set%led, the remaining amount of the toner is fed. However, this is not an effective method for feeding toner to the container. The operational efficiency thereof is very low.

Japanese Laid-Open Patent Publication No. 1-124503 discloses an apparatus in which a container is first evacuated and powder is fed into the evacuated container from a powder feed device at high speed at one time by using the difference between the pressure in the container and that in the powder feed device, thus filling the container with powder with high density.

In the above-described apparatus, the container is placed in an evacuation case, and both the inside and the outside of the container is evacuated. A nozzle is disposed at the bottom end of a hopper storing toner. A bottom opening of the nozzle is opened and closed by the vertical movement of a conical valve element tapered upward. The end portion of the nozzle is located inside the evacuation case in which the container is placed. When toner is fed into the container, the inside and the outside of the container are first evacuated in the evacuation case, and a toner inlet of the container is fitted to the end portion of the nozzle. Then, the valve element is moved downward to release the bottom opening of the nozzle. This allows the toner stored in the hopper to drop into the container at high speed through the nozzle to fill the container with the toner. Simultaneously with the drop of the toner, air is introduced to the evacuation case so that the atmospheric pressure is resumed, thus preventing the container from being broken by the high-speed toner drop.

The above-described apparatus solves the problem of reducing the bulk density of powder accumulated in the container because the container has been evacuated before the powder is fed thereinto and thus does not contain air.

However, the above-described method requires complicated steps which include placing the container in the evacuation case under the condition of the nozzle being opened with the valve element, evacuating the evacuation case to evacuate the inside of the container, and then feeding the powder into the container by opening the nozzle with the valve element. Thus, a longer time is required for filling a single container, which reduces the operational efficiency.

Further, because the toner drops into the container at high speed and the container is evacuated, the toner accumulated in the container may be excessively compressed. Especially, at the time immediately after the start of the toner feeding, when the pressure in the container is greatly different from that in the hopper, the toner dropping inside the container violently collides against the bottom of the container, thereby producing a great force exerted on the toner. As a result, the toner may be lumped at the bottom of the container depending on the size of the toner particles. When a container having such a lump of toner is mounted on an image forming apparatus to be used for image formation, the toner will not be smoothly supplied from the container to the apparatus.

Moreover, when the toner dropping from the hopper at high speed passes through the lower narrowed portion of the hopper, a great force is exerted on the dropping toner. At this time, air contained in the toner is greatly compressed as it comes closer to the lower portion of the hopper. This may cause the air to be blown upward before flowing down from the hopper, and thus the powder remaining in the hopper may be blown upward, partly scattered out of the hopper. When some of the toner is scattered outside, the predetermined amount of toner can not be fed to the container.

Furthermore, in case where the bottom opening of the nozzle and the toner inlet of the container are not completely sealed with each other, the toner may be scattered through the gap therebetween. The toner attached to the outer circumference of the nozzle may be swept off therefrom when a new container is fitted to the nozzle. This results in contaminating the container and the neighboring area. The toner scattered from the container also contaminates the container and the neighboring area. To remove such toner attaching to the container and scattered to the neighboring area, it is necessary to temporarily stop the filling operation, which greatly lowers the operational efficiency.

SUMMARY OF THE INVENTION

The powder filling apparatus of this invention includes: a rotary filling device for filling a container with powder, including a plurality of work units arranged to move around along the same circumference, wherein a container is carried into each of the work units during the movement of the work units, both the inside and the outside of the container are equally evacuated, and powder is dropped into the container while the pressure outside the container is raised; a carrying-in device for carrying a container into each of the work units moving around successively; a toner dispenser for dispensing and supplying a predetermined amount of toner to each of the work units moving around successively; and a carrying-out device for carrying the container filled with powder from each of the work units successively during the moving around of the work units.

Alternatively, the method for filling a container with powder according to the present invention includes the steps of: carrying a container into a plurality of work units moving around successively; evacuating equally the inside and the outside of the container carried into each of the work units while the work units move around; filling the container with powder by dropping the powder into the container simultaneously with raising the pressure outside the container while the work units move around; and carrying out the container from each of the work units successively while the work units move around.

Alternatively, the cleaner for cleaning a nozzle portion according to the present invention, disposed in a powder filling apparatus for filling a container with powder by equally evacuating the inside and the outside of the container, and dropping powder through the nozzle portion into the container simultaneously with raising the pressure outside the container, the cleaner including: a cleaner head having a cleaning chamber therein for enclosing the nozzle portion airtightly with a gap formed between the cleaner head and the nozzle portion; a gas passage disposed in the cleaner head for allowing compressed air to flow therethrough so as to spurt the compressed air to the nozzle portion; and an exhaust passage for allowing powder flowing down in the cleaning chamber together with the compressed air spurted to the nozzle portion to be discharged together with the compressed air.

According to the toner filling apparatus of the present invention, the container is carried to each of the work units successively with the carrying-in device. The container is filled with a predetermined amount of powder in a series of operations at high speed while the work unit with the container moves around along the circumferential movement area. The container filled with powder is carried out successively with the carrying-out device. In this way, according to the powder filling apparatus of the present invention, it is possible to fill a number of containers with powder with high efficiency.

When the valve element is lowered to release the bottom opening of the nozzle portion, powder stored in the hopper drops, while being straightened by the straightening member, through the nozzle portion into the evacuated container fitted to the nozzle portion at high speed. The powder dropping from the nozzle portion into the container collides against the buffer portion of the valve element, which alleviates the shock received by the container due to the high-speed drop of the toner. As a result, the powder is prevented from being lumped in the container.

When the container is fitted to the nozzle portion, since the guide portion forming the lower part of the valve element guides the powder inlet of the container to proceed to the valve element, the valve element can be easily inserted into the container. The gap between the nozzle portion and the container is minimized, thereby preventing the toner from attaching to the outer circumference of the nozzle portion. When the container has a member protruding beyond the level of the powder inlet, the member is pressed downward by the pusher member, allowing the container to be easily released from the nozzle portion.

The nozzle portion of the powder filling apparatus is cleaned with the cleaner. The cleaner head of the cleaner encloses the nozzle portion. Compressed air is supplied to the gas passage to be spurted directing to the nozzle portion, thereby removing powder attached to the nozzle portion. The powder removed from the nozzle portion is discharged outside from the cleaning camber through the exhaust passage. Alternatively, when the cleaner encloses the nozzle portion, compressed air is supplied to the compressed air passage and spurted into the cleaning chamber so that air from outside flows into the cleaning chamber. The air flows down along the nozzle portion while removing powder attached to the nozzle portion.

Thus, the invention described herein makes possible the advantages of (1) providing a powder filling apparatus in which a container can be filled with powder with high density in a shorter time by evacuating the container when the powder is fed to the container and thus the operational efficiency can be increased, (2) providing a powder filling apparatus in which a container can be filled with powder with high density at high speed and at the same time it is ensured to prevent the powder fed in the container from being lumped, and (3) providing a powder filling apparatus in which it is ensured to prevent powder from being scattered outside the container as well as from attaching to the nozzle or the like.

These and other advantages of the present invention will become apparent to those skilled in the art upon reading and understanding the following detailed description with reference to the accompanying figures.

DESCRIPTION OF THE PREFERRED EMBODIMENTS

The present invention will be herein described by way of examples with reference to the accompanied drawings.

Figure 1:
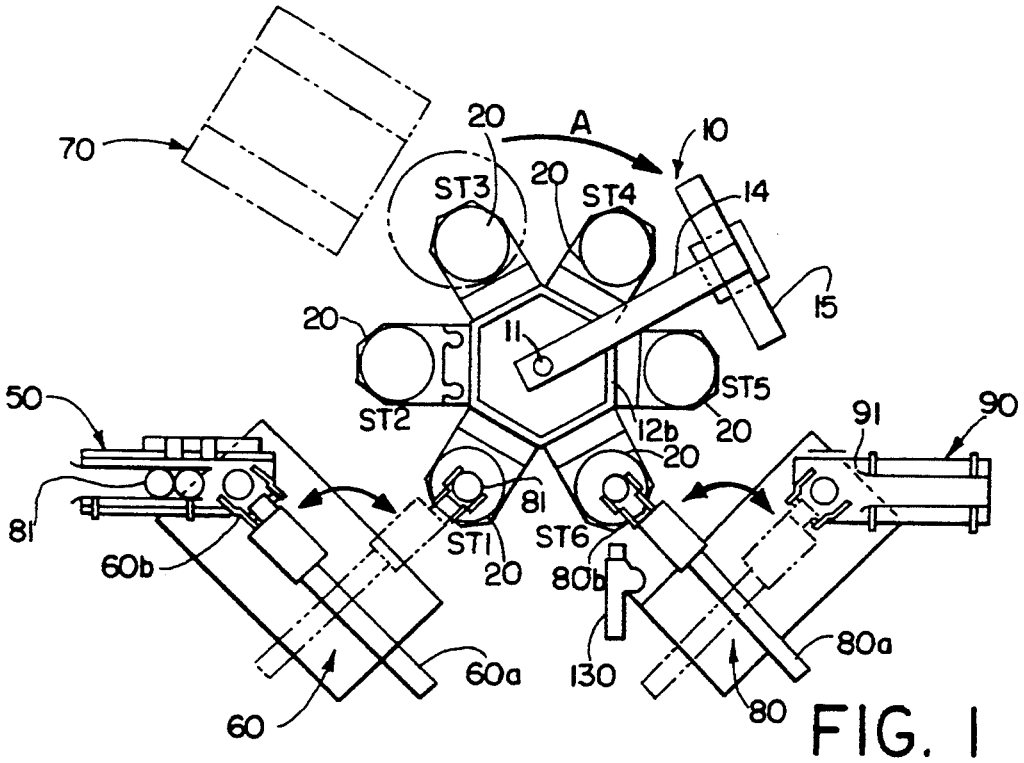
FIG. 1 is a schematic plan view showing a toner filling apparatus as an example of the powder filling apparatus according to the present invention.

Referring to FIG. 1, the toner filling apparatus as an example of the powder filling apparatus according to the present invention includes a rotary filling device 10 having six work units 20 arranged in the circumferential direction at the same intervals, and integrally rotated in the direction shown by the arrow A. The apparatus also includes a transport-in conveyor 50 for transporting bottles 81 as the containers to be filled with toner to a site in the vicinity of the rotary filling device 10. The transport-in conveyor 50 is disposed so that the terminal portion thereof is located in the vicinity of the rotary filling device 10. The apparatus further includes a toner dispenser 70 for dispensing a predetermined amount of toner to each work unit 20 of the rotary filling device 10.

Figure 7:
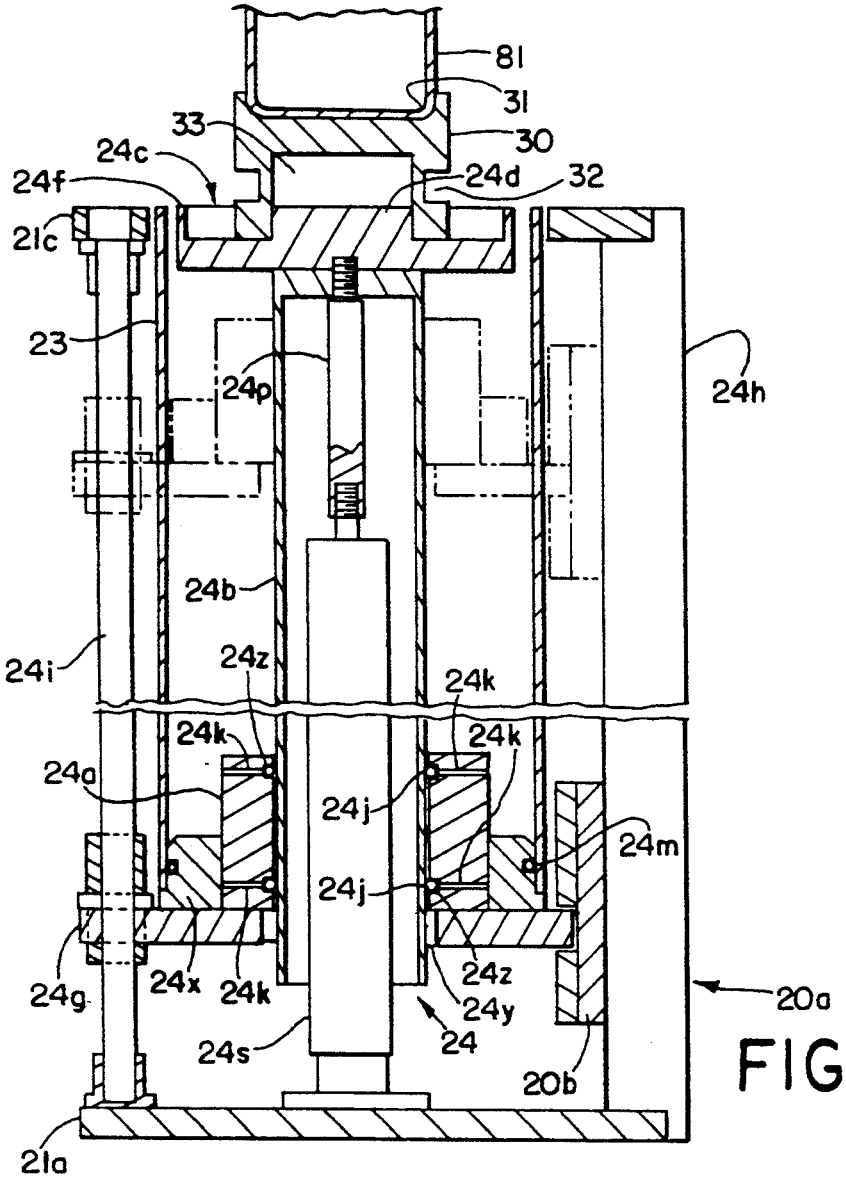
FIG. 7 is a sectional view showing the lower portion of the work unit of FIG. 3 according to the present invention.

Each of the bottles 81 has a toner inlet 81*a* protruding upward at the top end thereof (refer to FIG. 2), and is held on s retainer 30 as is shown in FIG. 7, for example. Such bottles 81 are sequentially transported with the transport-in conveyor 50 with the labeled side thereof facing a specific direction. A carrying-in device 60 is disposed between the rotary filling device 10 and the terminal portion of the transport-in conveyor 50, and carries the bottle 81 onto a predetermined position in each of the work units 20 successively.

The carrying-in device 60 includes an arm 60*a* which horizontally swings 90° and a chucking claw 60*b* disposed on the top end of the arm 60*a*. The chucking claw 60*b* chucks the retainer 30 holding the bottle 81 transported with the transport-in conveyor 50. Then, the arm 60*a* swings by 90° carrying the bottle 81 to the work unit 20.

Six work stations ST1 to ST6 are disposed at the same intervals along the circumferential movement area of the work units 20. The work units 20 are turned to the six work stations ST1 to ST6 successively. At each of the work stations ST1 to ST6, steps for filling the bottle 81 with toner are performed in order. At the work station ST6, the bottle 81 filled with toner is taken out by a carrying-out device 80 onto a transport-out conveyer 90 to be transported for a further process. The transport-in conveyor 50 and the transport-out conveyor 90 are disposed to extend on the same straight line.

Figure 2:
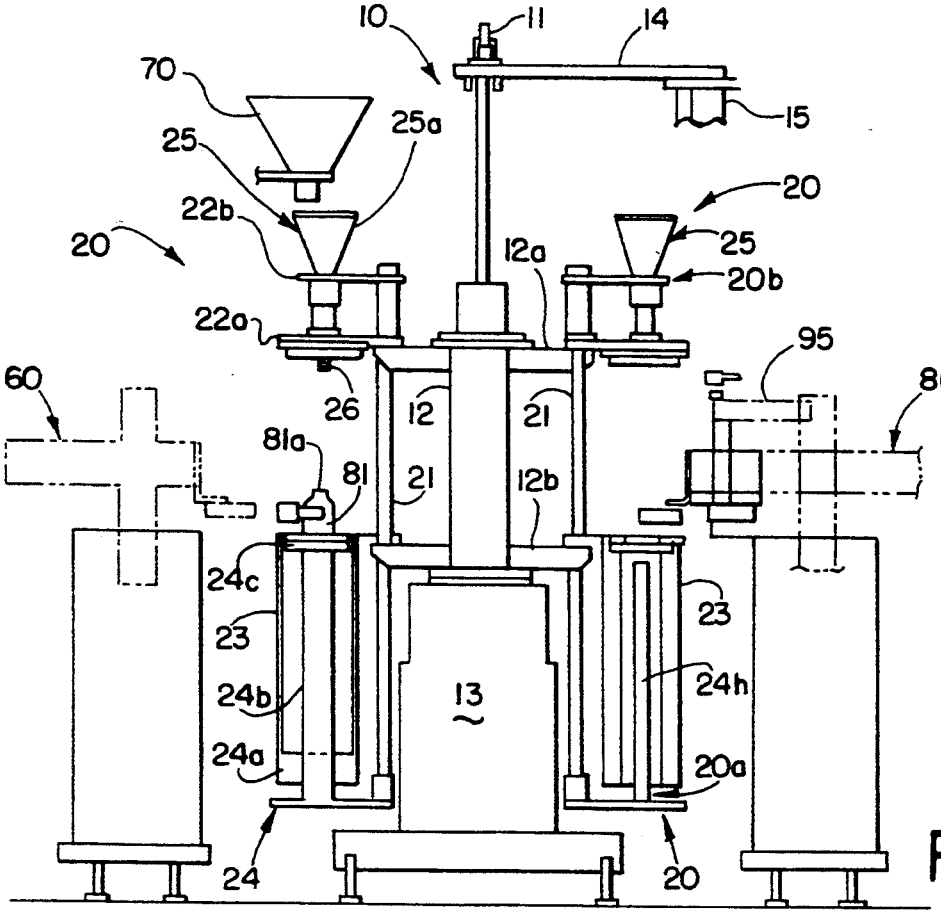
FIG. 2 is a schematic side view of the toner filling apparatus of FIG. 1 according to the present invention.

As is shown in FIG. 2, the rotary filling device 10 includes a cylindrical pedestal 13 in the center thereof. The pedestal 13 has a direct drive motor (not shown) incorporated therein. A hollow rotation shaft 12 connected to an output shaft of the direct drive motor extends upward from the top end of the pedestal 13. A hollow connecting shaft 11 is connected to the top end of the rotation shaft 12, and the top end of the connecting shaft 11 is connected to one end of a hollow horizontal connecting shaft 14. The other end of the horizontal connecting shaft 14 is connected to a hollow base support 15 standing outside the work stations ST1 to ST6.

Figure 3:
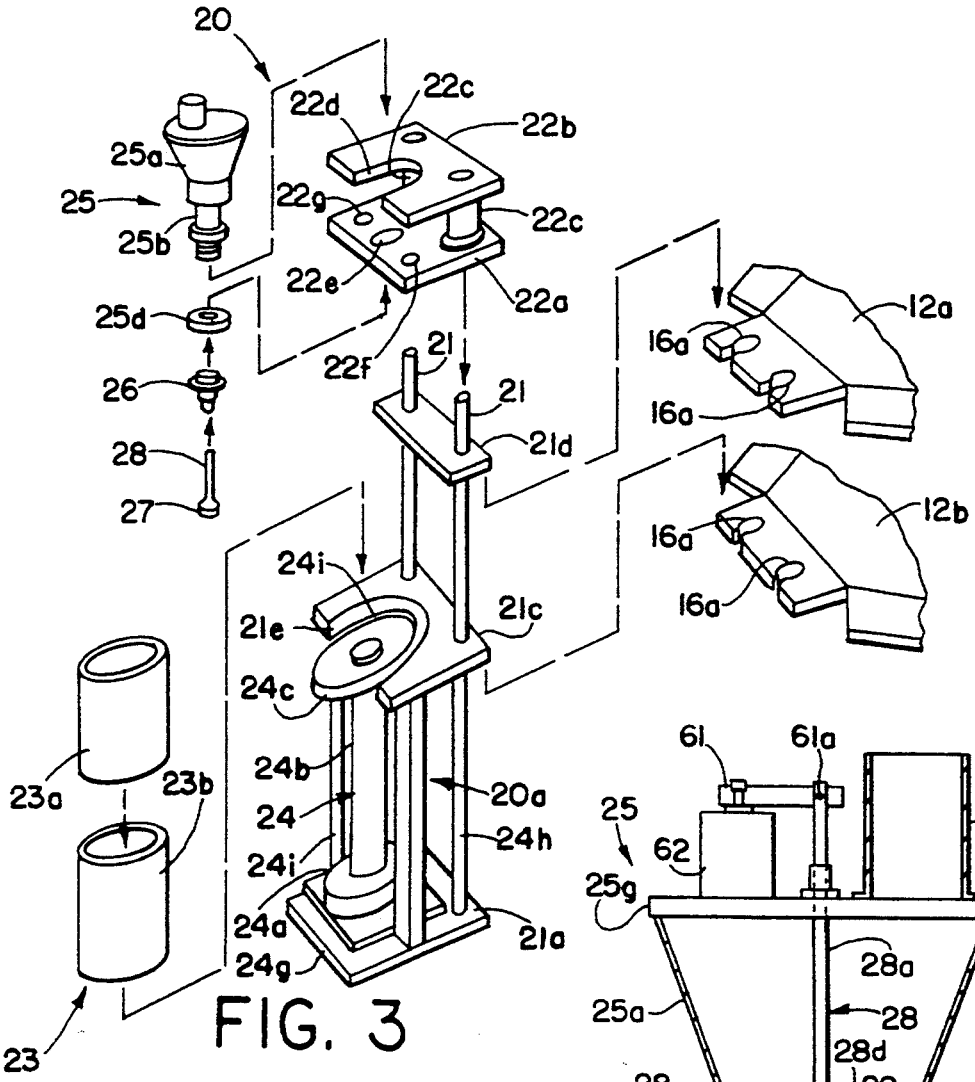
FIG. 3 is an exploded perspective view showing a work unit of the toner filling apparatus of FIG. 1 according to the present invention.

Hexagonal support plates 12*a* and 12*b* are horizontally fixed to the top and bottom portions of the rotation shaft 12, respectively. As is shown in FIG. 3, the work units 20 are secured to the six side faces of each of the support plates 12*a* and 12*b*, respectively.

The upper portion of each work unit 20 includes a toner feed mechanism 25 for storing a predetermined amount of toner to be fed to the bottle 81. The toner feed mechanism 25 includes a hopper 25*a* in which a predetermined amount of toner is stored, a nozzle 26 coupled to the bottom end of the hopper 25*a*, and a valve element 27 (FIG. 3) disposed so as to be movable vertically with respect to the bottom end of the nozzle 26.

The lower portion of the work unit 20 includes a table 24*c* on which the bottle 81 is placed and a table lifting mechanism 24. The table 24*c* is moved vertically, keeping the horizontal level thereof, by means of the table lifting mechanism 24. The lower portion of the work unit 20 also includes a cylindrical capsule 23 and a capsule lifting mechanism 20*a*. The capsule 23 is moved vertically, keeping an airtight contact with the outer circumference of the table 24*c*, by means of the capsule lifting mechanism 20*a*. The capsule 23 can be evacuated.

When the capsule 23 is lifted, it surrounds the bottle 81 placed on the table 24*c*, and the top end of the capsule 23 presses against a cover plate 22*a* disposed horizontally in the lower portion of the toner feed mechanism 25 to effect an airtight contact therewith. Thus, the inside the capsule 23 is sealed.

A power source (not shown) using a brush is disposed in the upper portion of the base support 15 for supplying electricity to the work units 20.

Figure 10:
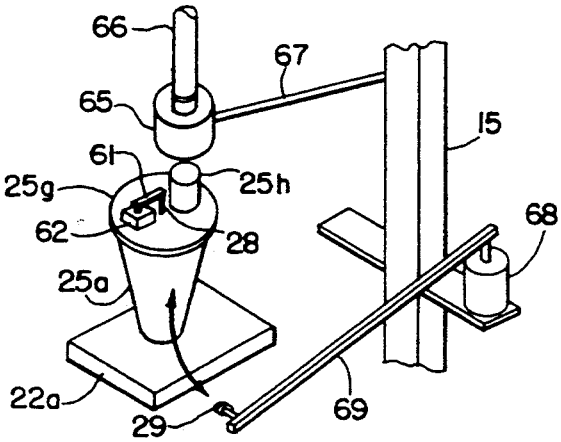
FIG. 10 is a perspective view showing a dust-collector and a knocker for a rotary filling device of the toner filling apparatus according to the present invention.

In the rotary filling device 10, as is shown in FIG. 10, the work units 20 move around intermittently with the rotation of the rotation shaft 12 so that each work unit 20 is turned to each of the work stations ST1 to ST6 in order.

At the work station ST1 located in the vicinity of the terminal portion of the transport-in conveyor 50, the bottle 81 is picked up from the terminal portion of the transport-in conveyor 50 and placed on the table 24*c* of the work unit 20. At the work station ST2, the capsule 23 is lifted to allow the top end thereof to press against the cover plate 22*a* airtightly. The capsule 23 is thus sealed and then subjected to a first evacuation. At the same time, the bottle 81 placed in the capsule 23 is also evacuated. At the work station ST3, a predetermined amount of toner is dispensed from the toner dispenser 70 disposed above the work station ST3. At the same time, the table 24*c* located in the capsule 23 is lifted so that the toner inlet 81*a* of the bottle 81 placed on the table 24*c* comes closer to the nozzle 26. Then, the capsule 23 is subjected to a second evacuation. At the same time, the bottle 81 placed in the capsule 23 is also evacuated. At the work station ST4, the table 24c is further lifted so that the toner inlet 81a of the bottle 81 is fitted to the nozzle 26. Then, the valve element 27 is lowered to open the nozzle 26 thus to allow the toner stored in the hopper 25a of the toner feed mechanism 25 to drop into the bottle 81. At this time, the pressure inside the capsule 23 is raised to resume the atmospheric pressure around the bottle 81. At the work station ST5, both the capsule 23 and the bottle 81 are lowered. At the work station ST6, the bottle 81 filled with toner is taken out onto the transport-out conveyor 90 by means of the carrying-out device 80.

The bottle 81 is kept fixed on the table 24c during the rotational movement of the work unit 20. Accordingly, when the work unit 20 arrives at the work station ST6, the bottle 81 has changed its direction by 300° a from the original position at the work station ST1. The bottle 81 as then taken out onto the transport-out conveyor 90 by means of the carrying-out device 80. Like the carrying-in device 60, the carrying-out device 80 includes an arm 80a which horizontally swings 90° and a chucking claw 80b attached to the top end of the arm 80a. The chucking claw 80b chucks the retainer 30 holding the bottle 81 placed on the table 24c. Then, the arm 80a swings 90° carrying the bottle 81 to a turning table 91 disposed at the start portion of the transport-out conveyor 90.

The turning table 91 horizontally swings 120° by means of a rotary-type air cylinder, for example. Accordingly, the bottle 81 which has been turned by 90° by means of the carrying-out device 80 is then turned by 120° with the turning table 91 before it is placed on and transported by the transport-out conveyor 90. As a result, the bottle 81 placed on the transport-out conveyor 90 faces the same direction as it faced when placed on the transport-in conveyor 50 for labeling or printing on a label attached thereto.

As is shown in FIG. 3, each of the work units 20 is removably supported by the support plates 12a and 12b fixed to the rotation shaft 12, so that the assembly, reassembly, and maintenance of the toner filling apparatus can be easily performed. Each work unit 20 includes a pair of hollow cylindrical supports 21 standing vertically. The pair of supports 21 are respectively inserted through a pair of cutouts formed on one of the side faces of each of the support plates 12a and 12b, so as to be vertically supported. A bottom plate 21a is horizontally fixed to the bottom ends of the pair of supports 21. A center fixing plate 21c and an upper fixing plate 21d are horizontally fixed to the pair of supports 21 at positions above the bottom plate 21 *a* having appropriate distances therefrom, respectively.

The bottom plate 21a is substantially square. The table lifting mechanism 24 is mounted on the center portion of the bottom plate 21a to drive the vertical movement of the table 24c on which the bottle 81 is placed. The capsule lifting mechanism 20a is disposed between the bottom plate 21a and the center fixing plate 21c to drive the vertical movement of the capsule 23 placed vertically. The capsule 23 lifted by the capsule lifting mechanism 20a surrounds the bottle 81 placed on the table 24c. The capsule 23 is composed of two separate parts, an upper capsule 23a and a lower capsule 23b, both of which are formed of a transparent synthetic resin and attached airtightly to each other. Thus, the capsule 23 can be easily separated into two parts, which is therefore convenient in the maintenance and transportation. Since the capsule 23 is made of a transparent resin, the dropping of toner can be visually observed or detected with an optical sensor disposed outside the capsule 23.

An upper support plate 22b is horizontally secured to the top ends of the pair of supports 21. The upper support plate 22b has a cutout 22d to which the hopper 25a of the toner feed mechanism 25 is fitted. Below the upper support plate 22b, the cover plate 22a is horizontally disposed. As described earlier, the top end of the capsule 23 presses against the bottom surface of the cover plate 22a. A pair of connecting pipes 22c are disposed between the cover plate 22a and the upper support plate 22b to connect them in parallel with a specified distance therebetween. The pair of connecting pipes 22c are fitted onto the top end portions of the pair of supports 21, respectively.

A cylindrical connecting tube 25b is attached to the bottom end of the hopper 25a. The cover plate 22a has a through hole 22e through which the connecting tube 25b is inserted. The cover plate 22a also has another two through holes, an evacuating hole 22f and an air inlet hole 22g, facing each other across the through hole 22e. The connecting tube 25b is inserted through the through hole 22e and then a fastening nut 25d is screwed onto the bottom end of the connecting tube 25b, whereby the hopper 25a and the connecting tube 25b are secured to the upper support plate 22b and the cover plate 22a. The nozzle 26 is screwed into the bottom end of the connecting tube 25b for allowing toner in the hopper 25a to drop into the bottle 81 in the table 24c. The valve element 27 is disposed at the bottom opening of the nozzle 26 to release and close the opening of the nozzle 26 by the vertical movement of the valve element 27. The valve element 27 is attached to the bottom end of a valve drive shaft 28 extending through the hopper 25a and the connecting tube 25b along the axial centers thereof.

Figure 4:
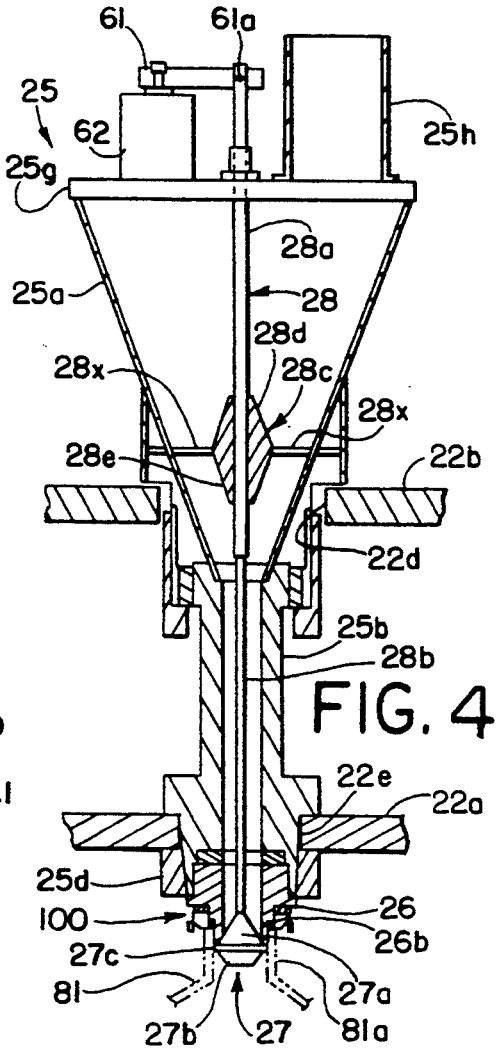
FIG. 4 is a sectional view showing a toner feed mechanism of the work unit of FIG. 3 according to the present invention.

Referring to FIG. 4, the toner feed mechanism 25 constituting the upper portion of the work unit 20 will be detailed. The hopper 25a is supported by the upper support plate 22b, and the valve drive shaft 28 extends through the hopper 25a along the axial center thereof. The valve drive shaft 28 also extends through the connecting tube 25b connected to the bottom end of the hopper 25a and through the nozzle 26 connected to the bottom end of the connecting tube 25b along the axial centers thereof. The valve element 27 is attached to the bottom end of the valve drive shaft 28. The connecting tube 25b is inserted through the through hole 22e formed in the cover plate 22a, and the nozzle 26 is screwed into the bottom end of the connecting tube 25b. The connecting tube 25b is removably fastened to the cover plate 22a with the fastening nut 25d. Since the nozzle 26 is removably screwed into the connecting tube 25b, it is possible to connect various types of nozzles having different inner diameters to the connecting tube 25b.

The valve drive shaft 28 extends upward through a cover 25g of the hopper 25a. The top end of the valve drive shaft 28 is connected to an air cylinder 62 mounted on the cover 25g through a connecting rod 61. The top end of the valve drive shaft 28 and the connecting rod 61 are connected to each other with a connecting pan 61a. This allows the valve drive shaft 28 and the connecting rod 61 to be easily separated only by removing the connecting pin 61a.

A cylindrical inlet tube 25h is also mounted on the cover 25g, through which toner is supplied into the hopper 25a. When the work unit 20 is turned to the work station ST3, the inlet tube 25h is positioned just under the outlet of the toner dispenser 70 to be aligned therewith. The sectional area of the inlet tube 25h and the inner volume of the hopper 25a are appropriately set so as to prevent toner supplied from the toner dispenser 70 from being scattered around.

The valve drive shaft 28 includes an upper valve drive shaft 28a extending through the hopper 25a and a lower valve drive shaft 28b extending through the connecting tube 25b. The upper valve drive shaft 28a has a larger diameter than the lower valve drive shaft 28b. The diameter of the upper valve drive shaft 28a is set to be large enough to be protected from being broken by the force of the toner dropping through the hopper 25a. The diameter of the lower valve drive shaft 28b is set so that the sectional area of the lower valve drive shaft 28b should be 6% or less of that of the toner passage of the connecting tube 25b through which toner drops so as to ensure smooth dropping of the toner.

A straightening core 28c is disposed in the lower portion of the hopper 25a. The straightening core 28c guides the toner to smoothly drop to the connecting tube 25b. The straightening core 28c is vertically supported by a support member 28x fixed horizontally and radially to the inner wall of the hopper 25a. The valve drive shaft 28 slidably extends through the axial center of the straightening core 28c. The straightening core 28c includes upper and lower portions 28d and 28e which have truncated-cone shapes tapered upward and downward, respectively. The upper portion 28d of the straightening core 28c has an inclination angle of 50° or more which is an angle of repose. This inclination angle prevents the toner colliding against the upper portion 28d of the straightening core 28c from splashing and scattering around. The lower portion 28 *e* of the straightening core 28c has an inclination angle substantially identical to that of the inner wall of the lower portion of the hopper 25a. As a result, the space between the lower portion of the hopper 25a and the lower portion 28e of the straightening core 28c is uniform everywhere. This prevents toner from being left behind in the lower portion of the hopper 25a.

Figure 5:
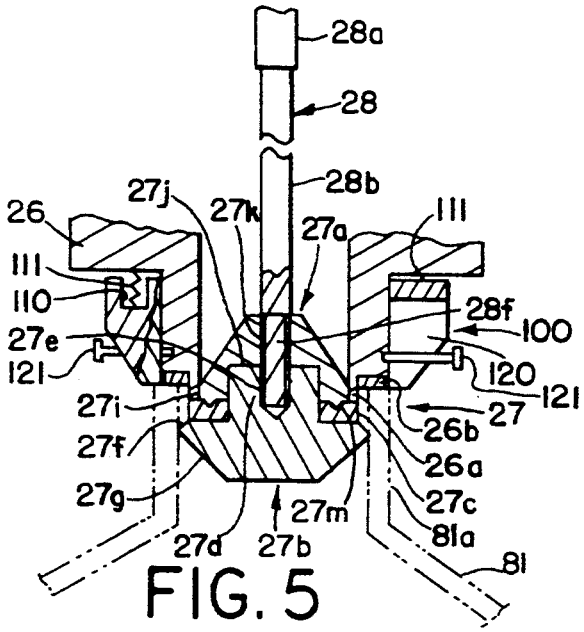
FIG. 5 is a sectional view showing a nozzle and a valve element of the toner feed mechanism of FIG. 4 according to the present invention.

As is shown in FIG. 5, the nozzle 26 connected to the hopper 25a through the connecting tube 25b has an toner passage having the same inner diameter as that of the connecting tube 25b, and has a protrusion 26a with a reduced outer diameter at the bottom end thereof. A nozzle packing 26b is attached around the top end of the protrusion 26a, so that the top end of the toner inlet 81a of the bottle 81 can be pressed against the nozzle packing 26b airtightly. Since the protrusion 26a has a fixed outer diameter and the gap between the protrusion 26a and the toner inlet 81a is small when the protrusion 26a is inserted into the toner inlet 81a, the problem of toner getting into the gap can be prevented.

The valve element 27 attached to the bottom end of the valve drive shaft 28 includes an upper buffer portion 27a and a lower guide portion 27b. The buffer portion 27a has a truncated-cone shape tapered upward and is fitted into the nozzle 26. The guide portion 27b has a truncated-cone shape tapered downward. A ring packing 27c is disposed between the buffer portion 27a and the guide portion 27b. The buffer portion 27a and the guide portion 27b are separable from each other.

A cylindrical recess 27j coaxial with the buffer portion 27a is formed on the bottom surface of the buffer portion 27a. A cylindrical protrusion 27d which matches the cylindrical recess 27j is formed on the center portion of the top surface of the guide portion 27b. A screwed through hole 27k is formed through the buffer portion 27a along the axial center thereof. A screwed hole 27e aligned with the through hole 27k is formed on the guide portion 27b along the axial center thereof. A male screw 28f is formed on the bottom portion of the valve drive shaft 28, and screwed through the through hole 27k of the buffer portion 27a and then screwed into the screwed hole 27e of the guide portion 27b. The packing 27c is fitted around the protrusion 27d of the guide portion 27b and held between the buffer portion 27a and the guide portion 27b. Point projections 27m pointing downward are formed over the bottom surface of the buffer portion 27a in the circumferential direction so as to cut into the packing 27c. The packing 27c has the shape of a thin plate, and the peripheral portion thereof protrudes beyond the outer circumference of the bottom portion of the buffer portion 27a which has a fixed outer diameter smaller than that of the packing 27c.

When the valve drive shaft 28 is lifted, the entire valve element 27 is also lifted. At this time, the buffer portion 27a is fitted into the bottom portion of the nozzle 26, and the protruded peripheral portion of the packing 27c abuts against the bottom end of the nozzle 26 and presses it airtightly. When the valve element 27 is lowered as the valve drive shaft 28 is lowered, the packing 27c releases the bottom opening of the nozzle 26, thereby allowing the toner stored in the hopper 25a to drop down through the opening. The toner dropping down through the nozzle 26 collides against the buffer portion 27a of the valve element 27 located below the nozzle 26. Since the buffer portion 27a has a truncated-cone shape tapered upward, the toner dropping from the connecting tube 25b (see FIG. 4) which collides the buffer portion 27a flows along the slope of buffer portion 27a thus reducing the drop speed thereof.

As mentioned earlier, the bottom portion of the buffer portion 27a has a fixed outer diameter which is smaller then that of the packing 27c. This allows the buffer portion 27a to be guided into the bottom portion of the nozzle 26 even if the centers of the valve element 27 and the nozzle 26 are deviated from each other. Thus, it is ensured that the protruded peripheral portion of the packing 27c and the bottom and of the nozzle 26 are pressured against each other. Since the packing 27c has the shape of a thin plate and the point projections 27m cut into the packing 27c, the toner will not get into the center of the buffer portion 27a.

The guide portion 27b of the valve element 27 has an outer diameter first increasing to form a shoulder portion 27f below the packing 27c and then gradually reducing to form a tapered outer circumference 27g. The slope of the outer circumference 27g has an angle of 45° or more, and guides the toner inlet 81a to proceed to abut against the nozzle packing 26b attached to the nozzle 26 when the bottle 81 is lifted.

The valve element 27 is replaceable when the type of the container is changed. The valve element 27 is removed integrally with the valve drive shaft 28 from the toner feed mechanism 25 by first releasing the valve drive shaft 28 extending through the cover 25g of the hopper 25a from the linkage with the connecting rod 61 by removing the connecting pin 61a and then sliding down the valve drive shaft 28 (see FIG. 4). When a new valve element is to be mounted to the toner feed mechanism 25, the valve drive shaft 28 with the valve element 27 attached thereto is inserted from the bottom opening of the nozzle 26 upward through the axis of the straightening core 28c to extend through the cover 25g. Then, the top and of the valve drive shaft 28 is connected to the connecting rod 61 with the connecting pin 61a.

Figure 6:
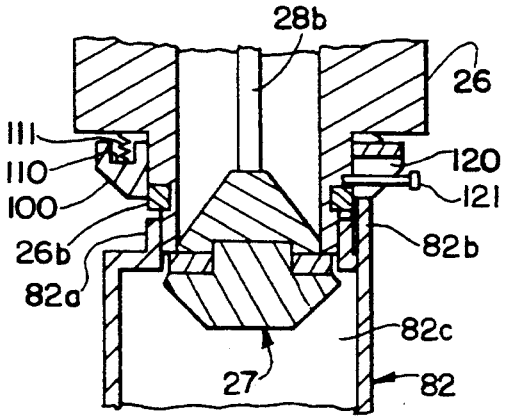
FIG. 6 is a sectional view showing the operation of a pusher disposed on the nozzle of FIG. 5 according to the present invention.

Next, the case where a cartridge 82 having a rectangular parallelepiped shape is used as a container to be filled with toner will be described. Referring to FIG. 6, a pusher 100 is disposed around the nozzle 26. The cartridge 82 includes a toner inlet 82a formed on an end face thereof and a toner outlet 82c formed on a side thereof. The toner outlet 82c, from which the toner is supplied to an image forming apparatus when the cartridge 82 is mounted therein, is covered with a sliding plate 82b. An end portion of the sliding plate 82b extends beyond the toner outlet 82c to the side of the toner inlet 82a. The sliding plate 82b is slided by pulling this end portion to open the toner outlet 82c. When the cartridge 82 is connected to the toner feed mechanism 25 to receive toner, the end portion of the sliding plate 82b extending upward beyond the level of the toner inlet 82a is pressed downward by the pusher 100.

The pusher 100 includes an upper cylindrical portion and a lower portion having a truncated-cone shape tapered downward. Four recesses 110 are formed on the top surface of the pusher 100 at the same intervals in the circumferential direction. A coil spring 111 is disposed in each of the recesses 110, and presses the pusher 100 downward so that the horizontal bottom surface of the pusher 100 is positioned at a lower level than that of the packing 26b. Four cutouts 120 are formed on the bottom surface of the pusher 100 at the same intervals an the circumferential direction. A pin 121 fixed to the nozzle 26 is inserted through each of the cutouts 120, to prevent the pusher 100 pressed downward by the coil springs 111 from falling down.

When the toner inlet 82a of the cartridge 82 is fitted to the nozzle 26 at the work station ST4 for filling the cartridge 82 with toner, the pusher 100 is moved upward by being pressed with the sliding plate 82b of the cartridge 82. When the cartridge 82 has been filled with toner and lowered downward, the pusher 100 presses the sliding plate 82b downward. This ensures the removal of the toner inlet 82a from the nozzle 26.

As is shown in FIG. 7, the lower portion of the work unit 20 includes the table lifting mechanism 24 for lifting the table 24c on which the bottle 81 is mounted, and the capsule lifting mechanism 20a for lifting the capsule 23. The table lifting mechanism 24 includes an air cylinder 24s which is secured vertically to the center portion of the bottom plate 21a fixed to the pair of supports 21 (refer to FIG. 3). The air cylinder 24s includes a piston rod 24p extending upward, and the table 24c on which the bottle 81 is mounted is horizontally fixed to the top and of the piston rod 24p. The table 24c has a cylindrical protrusion 24d on the center portion thereof.

The bottle 81 mounted on the table 24c is held by the retainer 30 so that the bottle 81 stands upright with the toner inlet 81a facing upward. The retainer 30 has a rectangular parallelepiped shape, and has a recess 33 formed on the center portion of the bottom surface thereof to fit to the protrusion 24d of the table 24c. Also, a recess 31 is formed on the top surface of the retainer 30 to fit to the bottom end of the bottle 81. Further, a chucking groove 32 is formed around the outer circumference of the retainer 30 to be chucked by the chucking claw 60b of the carrying-in device 60 and the chucking claw 80b of the carrying-out device 80. Accordingly, it is not necessary to change the chucking claws 60b and 80b even when the type of the bottle 81 is changed, as far as the new bottle 81 fits into the retainer 30.

A wall 24f is formed around the periphery of the table 24c to prevent toner dropping out onto the table 24c from being scattered around. The table 24c is formed of a white resin or metal with a mirror finished surface, for example, so that an optical sensor can detect a change of the reflectance of the table 24c caused by the presence of toner on the table 24c.

The piston rod 24p of the air cylinder 24s stretches and retracts with air pressure to lift and lower the table 24c. The air pressure is set higher when the piston rod 24p is lowered than when it is lifted. The air cylinder 24s is surrounded with a cylindrical cover 24b.

The top end of the cover 24b is attached to the bottom and of the table 24c located on the top end of the piston rod 24p. When the piston rod 24p stretches, the cover 24b is lifted together with the table 24c. It is when the capsule 23 is being evacuated that the piston rod 24p is lifted. Since the capsule 23 is being evacuated, a force produced by the evacuation corresponding to the section of the cover 24b is added to the air pressure for lifting the piston rod 24p. That is, (the force for lifting the piston rod 24p)=(the evacuating force)+( the air pressure ). Accordingly, in order to prevent a damage to the bottle 81 caused by overload thereto at the time of contact of the bottle 81 to the nozzle 26, the air pressure should be as low as possible. On the other hand, when the bottle 81 is lowered to its lowest position where the bottle 81 is to be carried out, it is required to increase the speed of lowering so as to increase the manufacturing speed. Therefore, the air pressure should be as high as possible.

The capsule lifting mechanism 20a includes a rodless air cylinder 24h disposed vertically between the bottom plate 21a and the center fixing plate 21c (refer to FIG. 3). The air cylinder 24h includes a movable portion 20b. The movable portion 20b supports an end of a movable plate 24g having a through hole 24y. The cover 24b surrounding the air cylinder 24s of the table lifting mechanism 24 extends through the through hole 24y. The other end of the movable plate 24g is slidably supported with a pair of guide axes 24i, thereby allowing the movable plate 24g to be lifted or lowered with the rodless air cylinder 24h. The pair of guide axes 24i are vertically disposed between the bottom plate 21a and the center fixing plate 21c.

A cylindrical slider 24a is mounted on the movable plate 24g. The cover 24b extending through the through hole 24y of the movable plate 24g also extends through the axial center of the slider 24a. Ring grooves 24z are formed on the inner circumference of the slider 24a at an appropriate distance from the top and bottom ends thereof, respectively. Each of the ring grooves 24z receives an O-ring 24j which contacts airtightly with the outer circumference of the cover 24b. This airtight contact is kept when the cover 24b and the movable plate 24g vertically move relative to each other. Since the O-rings 24j are disposed both in the upper and lower positions of the slider 24a, the cover 24b is prevented from being inclined when it is vertically moved relative to the slider 24a, thus to ensure the precisely vertical movement of the cover 24b. There are formed a plurality of pores 24k which radially extend from the ring grooves 24z through the slider 24a. Thus, the O-rings 24j can be easily removed by inserting a pin into each pore 24k from the end on the outer circumference of the slider 24a to push out the O-ring 24j.

A capsule support 24x is fixed to the outer circumference of the slider 24a. The capsule support 24x has s flange formed on the bottom end of the outer circumference thereof to which the bottom end of the capsule 23 is fixed to be vertically supported. A packing 24m is disposed on the outer circumference of the capsule support 24x to contact airtightly with the inner circumference of the capsule 23. The elastic modulus of the packing 24m is set so that a gap of 1.70 mm or more be formed between the capsule support 24x and the capsule 23. This gap is large enough for the capsule 23 to be removed smoothly from the packing 24m, and at the same time small enough to keep the airtightness between the capsule 23 and the packing 24m.

When the capsule 23 is lifted by the air cylinder 24h of the capsule lifting mechanism 20a, the top end of the capsule 23 presses against the bottom surface of the cover plate 22a fixed to the pair of supports 21. As a result, the inside of the capsule 23 is sealed, and the table 24c and the bottle 81 are enclosed in the sealed capsule 23. The sealed capsule 23 is then evacuated with an evacuating device 94 (see FIG. 8) disposed in each work unit 20. At this time, the bottle 81 inside the capsule 23 is also evacuated. When evacuated, the bottle 81 is lifted in the capsule 23 by the air cylinder 24s of the table lifting mechanism 24, so that the toner inlet 81a of the bottle 81 fits to the nozzle 26.

The stroke of the stretch and retraction of the air cylinder 24s is adjustable depending on the height of the bottle 81 placed on the table 24c. Accordingly, any containers having different heights can be lifted and fitted to the nozzle 26 without trouble. The height of the table 24c is on the same level as the height of the center fixing plate 21c, so that the table lifting mechanism 24 can be housed under the center fixing plate 21c, thereby making the work unit 20 compact as a whole.

Figure 8:
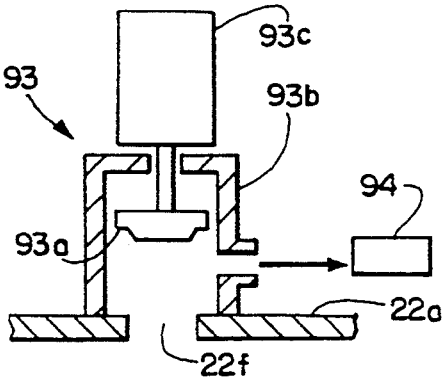
FIG. 8 is a partial sectional view showing a cover plate in the upper portion of the work unit of FIG. 3 according to the present invention.

The cover plate 22a to which the top end of the capsule 23 is pressed has the evacuating hole 22f as mentioned earlier. As is shown in FIG. 8, the evacuating hole 22f is covered with an electromagnetic open/-close valve 93, which is connected to the evacuating device 94 of an exhaust type. The open/close valve 93 includes a cylinder 93b and a valve element 93a which is disposed inside the cylinder 93b and driven by a solenoid 93c disposed outside the cylinder 93b to close the evacuating hole 22f airtightly. The inside of the cylinder 93b communicates with the evacuating device 94.

Figure 9:
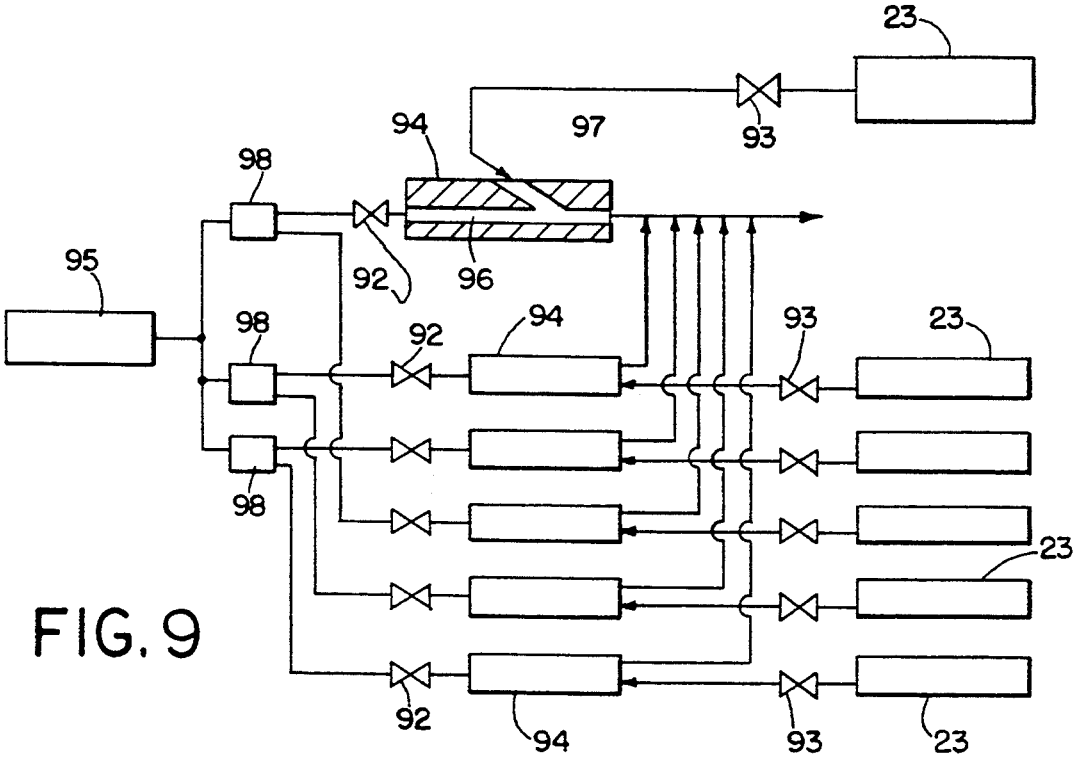
FIG. 9 shows evacuating devices and the piping arrangement for all the work units of the toner filling apparatus according to the present invention.

As is shown in FIG. 9, each of the evacuating devices 94 includes a main passage 96 through which high-pressure air flows and a sub-passage 97 communicating with the main passage 96 so as to be evacuated by the high-pressure air flowing through the main passage 96. The sub-passage 97 communicates through the open/close valve 93 to the evacuating hole 22f formed on the cover plate 22a. Accordingly, when high-pressure air flows through the main passage 96 of the evacuating device 94 under the condition that the capsule 23 is pressed against the cover plate 22a, the sub-passage 97 is evacuated and then the capsule 23 is evacuated through the evacuating hole 22f released by the open/close valve 93.

An electromagnetic open/close valve 92 is connected to the main passage 96 of the evacuating device 94 for each work unit 20. Each two of the open/close valves 92 are connected to a manifold 98, and a total of three manifolds 98 are connected to a single high-pressure air source 95. The open/close valves 92 for the work units 20 disposed in the opposite positions to each other is selected as the combination of the open/close valves connected to the same manifold 98. Evacuation of the capsule 23 for each work unit 20 is performed at the work stations ST2, ST3, and ST4, while it is not performed at the opposing work stations ST5, ST6, and ST1, respectively. Accordingly, each combination of the open/close valves 92 connected to the same manifold 98 are not driven simultaneously. This arrangement is advantageous in that the piping required for the evacuation can be simplified by using the manifold 98 and that is not necessary to use a large-size pipe for the connection to the manifold 98 as is normally done since the evacuating devices 94 connected to the manifold 98 are not driven simultaneously.

The high-pressure air is sent from the high-pressure air source 95 to the hollow connecting shaft 11 through the top and thereof, and supplied to the three manifolds 98 through three pipes (not shown). The high-pressure air then passes through a flexible connecting pipe and supplied to each of the evacuating devices 94 disposed inside the cover plate 22a via the open/close valve 92. The air from the evacuating device 94 then passes through one of the pair of supports 21 having a hollow inside, the hollow rotation shaft 12, and the hollow outlet shaft of the direct drive motor connected to the rotation shaft 12, to be exhausted outside. The evacuating device 94 is protected from having toner or the like staying therein because high-pressure air flows through both the main passage 96 and the sub-passage 97.

The air inlet hole 22g formed in the cover plate 22a is used for introducing air into evacuated capsule 23 so that the atmospheric pressure is resumed in the capsule 23. The air inlet hole 22g is provided with an electromagnetic open/close valve having a similar structure to that of the open/close valve 93 for the evacuating hole 22f as is shown in FIG. 8, for example.

As is shown in FIG. 10, a dust-collecting hood 65 is disposed for each of the work stations ST4 and ST5 at such a position as to face the inlet tube 25h of the hopper 25a for each work unit 20 when the work unit 20 is turned to the work stations ST4 and ST5. The dust-collecting hood 65 is supported by a support rod 67 fixed to the base support 15 of the rotary filling device 10. The dust-collecting hood 65 is connected to an and of a dust-collecting pipe 66 through which the inside of the dust-collecting hood 65 is evacuated.

Each of the work stations ST4 and ST5 is also provided with a knocker 29. A rotary cylinder 68 is disposed on the base support 15, and a connecting arm 69 is horizontally fixed to the rotary cylinder 68 at an end thereof so as to swing horizontally when the rotary cylinder 68 rotates. The knocker 29 is attached to the and of the connecting arm 69 facing the circumferential face of the hopper 25a. When the connecting arm 69 is moved closer to the hopper 25a, the knocker 29 collides against the circumferential face of the hopper 25a to give a shock to the hopper 25a. By this operation, it is ensured that any toner staying inside the hopper 25a is removed therefrom and drops through the nozzle 26.

A cleaner 130 is disposed at the work station ST6 at a position outside the circumferential movement area of the work unit 20 as is shown in FIG. 1, for removing toner attached to the valve element 27 and the inner walls of the nozzle 26 and the hopper 25a. When the work unit 20 is turned to the work station ST6, the cleaner 130 moves toward the work unit 20 to a specified position below the nozzle 26 of the toner feed mechanism 25, as is shown in FIG. 11.

Figure 11:
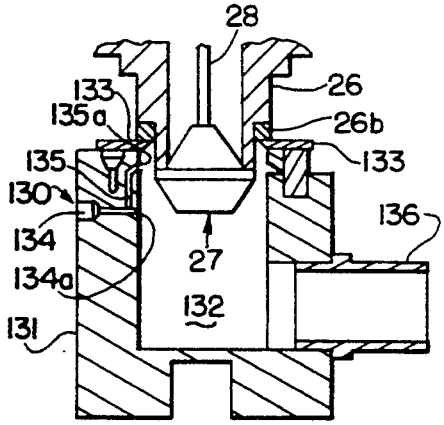
FIG. 11 is a sectional view of a cleaner for the rotary filling device according to the present invention, showing the condition when it is attached to the valve.

Referring to FIG. 11, the cleaner 130 includes a cylindrical cleaner head 131 having an opening at the top thereof. A cleaning chamber 132 is formed inside the cleaner head 131. A ring flange 133 is attached to the top end rim of the cleaner head 131. The flange 133 extends beyond the rim of the cleaner head 131 toward the opening so that it can press against the nozzle packing **26*b* of the nozzle 26. Compressed air passages 134 are formed at four places along the outer circumference of the upper portion of the cleaner head 131. The compressed air passages 134 extend horizontally through the wall of the cleaner head 131. A compressed air pipe (not shown) is connected to the outer end of each of the compressed air passages 134 to supply compressed air thereto through an electromagnetic valve for controlling the supply of compressed air. A reduced-diameter spurt outlet 134*a* is formed et the inner end of the compressed air passage 134, which faces the bottom end of the valve element 27. Compressed air is spurted from the spurt outlet 134*a* to the side face of the valve element 27 so as to remove toner attached to the side face of the valve element 27. The compressed air passage 134 has a branch passage 135 extending upward through the wall, so that the compressed air supplied to the compressed air passage 134 also flows through the branch passage 135. The branch passage 135 has a spurt outlet 135*a* at the inner end thereof which is open in an upward oblique direction, so that the compressed air spurted from the spurt outlet 135*a* can be directed to the bottom surface of the nozzle packing 26*b* and the outer circumference of the nozzle 26 below the nozzle packing 26*b* and then flow down along the outer circumference of the nozzle 26**.

An exhaust passage 136 is connected to the lower portion of the cleaner head 131 so as to communicate with the cleaning chamber 132. The other end of the exhaust passage 136 is connected to a dust collector (not shown) so that toner or other powdery dust in the cleaning chamber 132 can be discharged by being absorbed by the dust-collector through the exhaust passage 136.

The operation of the cleaner 130 having the above-described structure will be described. When the work unit 20 is turned to the work station ST6, the cleaner head 131 of the cleaner 130 is moved to a position below the nozzle 26 and the valve element 27 of the unit 20, and then lifted so that the nozzle 26 and the valve element 27 are fitted into the cleaner head 131 from the top opening thereof. Under the above condition, compressed air is spurted from the spurt outlet **134*a* horizontally toward the bottom side face of the valve element 27 thus to remove any toner attached thereto. At the same time, compressed air is spurted from the spurt outlet 135*a* in the upward oblique direction toward the bottom surface of the nozzle packing 26*b*. The compressed air splashing from the nozzle packing 26*b* then flows down along the outer circumference of the nozzle 26 and the outer circumference of the valve element 27, thus to remove toner attached to the nozzle packing 26*b* and the outer circumference of the nozzle 26. At this time, toner entering the gap between the flange 133 and the nozzle 26 can also be removed. Further, toner once removed from the nozzle 26 and the valve element 27 by the compressed air spurted horizontally from the spurt outlet 134*a* can be prevented from reattaching to the nozzle 26 and the valve element 27. The toner removed in this way drops to the cleaning chamber 132 and is discharged through the exhaust passage 136**.

Figure 12:
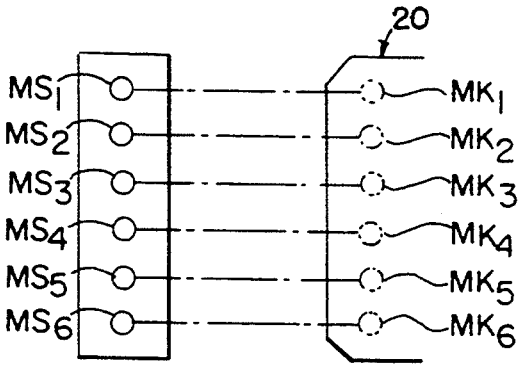
FIG. 12 shows the relationship between unit sensors and objects to be detected for identifying the work units according to the present invention.

In the above-described toner filling apparatus, it is required to identify which one of the six work units 20 is located on each of the work stations ST1 to ST6. For this purpose, the toner filling apparatus according to the present invention is provided with six magnetic unit sensors MS1 to MS6 arranged at appropriate intervals as is shown in FIG. 12. The magnetic unit sensors MS1 to MS6 are disposed at one of the work stations, for example, at the work station ST2 in the vicinity of the circumferential movement area of the work units 20. On the other hand, each of the work units 20 is provided with one of the magnetic objects MK1 to MK6 at a position which is closest to one of the unit sensors MS1 to MS6 when the work unit 20 is placed on the work station ST2 where the unit sensors MS1 to MS6 are disposed. Accordingly, it is possible to identify which work unit 20 is placed on the work station ST2 by observing which one of the unit sensors MS1 to MS6 has detected its corresponding one of the magnetic objects MK1 to MK6.

Further, in order to allocate each work unit 20 on each of the work stations ST1 to ST6 at the start of the filling operation, a magnetic object for allocation is attached to all of the work units 20 at an identical position thereof. A sensor for allocation is disposed at one of the work stations ST1 to ST6, for example at the work station ST5, for detecting any one magnetic object attached to one of the work units 20 when the work unit 20 has arrived at a specified position of the work station ST5. Thus, the filling operation can be started at the moment when the sensor for allocation detects the arrival of any one of the work units 20 at the specified position of the work station ST5 where the sensor for allocation is disposed.

Now, the filling operation performed by the toner filling apparatus having the above-described structure will be described with reference to operational diagrams shown in FIGS. 13A to 13F and flowcharts shown in FIGS. 14 to 19.

Figure 13A:
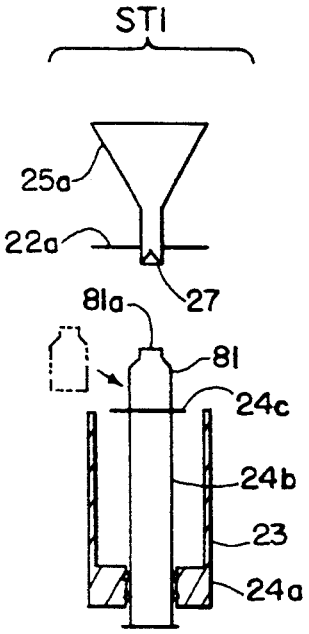
FIGS. 13A to 13F are schematic views illustrating the operations at six work stations in the rotary filling device according to the present invention, respectively.

First, before the start of the filling operation, the work units 20 are allocated to the work stations ST1 to ST6, respectively. At the work station ST1, as is shown in FIG. 13A, when the work unit 20 is appropriately placed on the work station ST1, the capsule 23 is located at the lowest position thereof, and thereby the table **24*c* is positioned above the top end of the capsule 23. The nozzle 26 of the toner feed mechanism 25 in the upper portion of the work unit 20 has been closed by the valve element 27** which is located at the highest position thereof.

Figure 14:
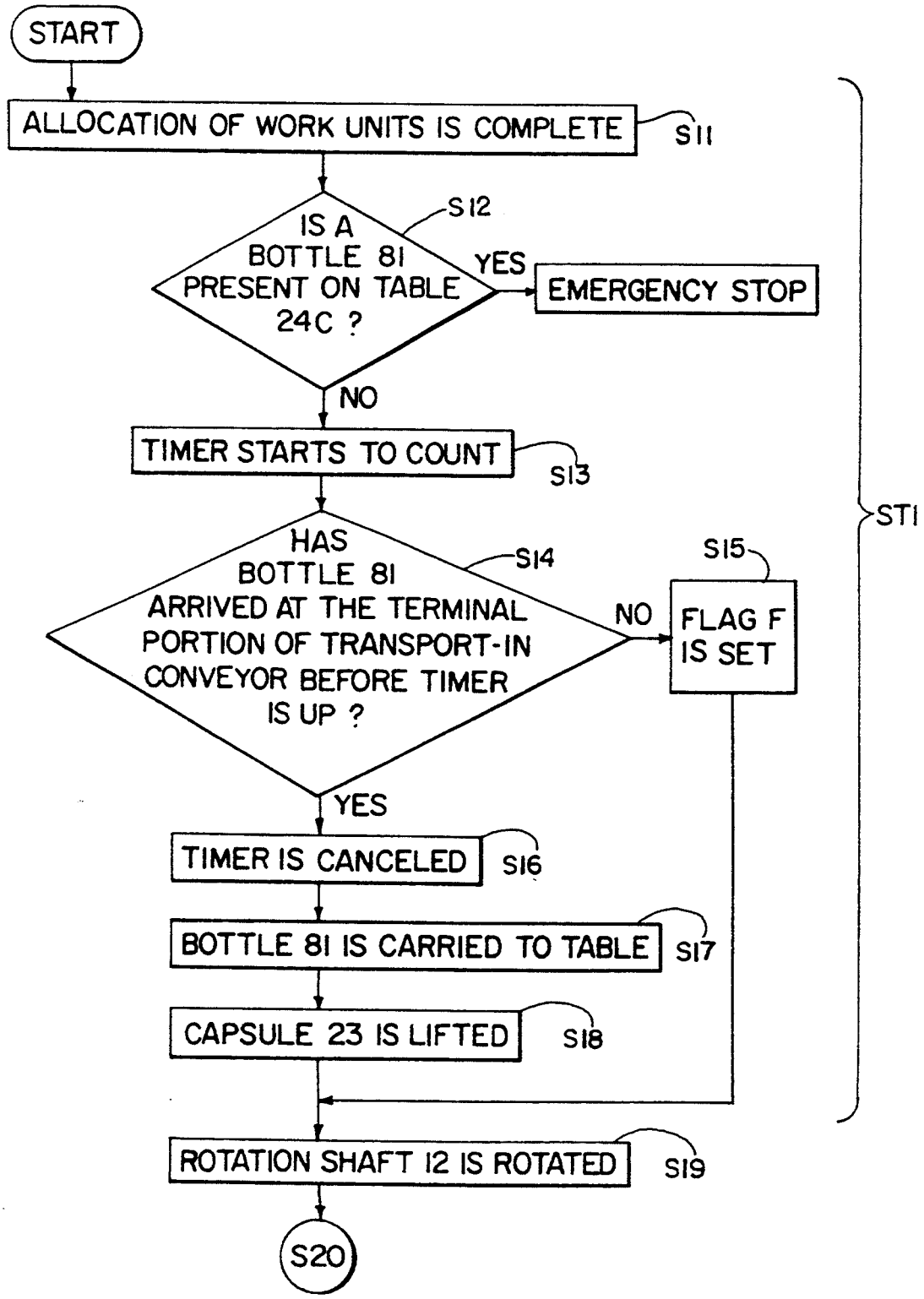
FIGS. 14 to 19 are flowcharts showing the operations at the first to sixth work stations, respectively.

Referring to the flowchart in FIG. 14, at the work station ST1, when the allocation of the work units 20 is complete (step S11), whether the bottle 81 is present on the table **24*c* at the work station ST1 is checked (step S12). When the bottle 81 is present, the apparatus stops as an emergency. When the bottle 81 is not present, a timer immediately starts to count (step S13). Then, it is checked whether the bottle 81 has been transported to the terminal portion of the transport-in conveyor 50 until a predetermined time period set for the timer has elapsed, (step S14). When the bottle 81 has not been transported to the terminal portion of the transport-in conveyor 50, a flag F is set (step S15) to instruct the work stations ST2 to ST6 not to perform the subsequent steps for filling the bottle 81 with toner. When the bottle 81 has been transported, the counting of the timer is canceled (step S16), the bottle 81 is placed on the table 24c at the work station ST1 by means of the carrying-in device 60 (step S17), and the capsule lifting mechanism 30 is driven to lift the capsule 23 (step S18). When the flag F is set or the capsule 23 is lifted, the rotation shaft 12 is rotated to turn all of the work units 20 integrally, so that the work unit 20** located at the work station ST1 is moved to the next work station S2Ta (step S19).

Figure 13B:
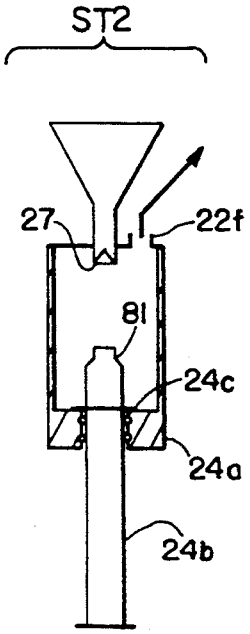
Figure 15:
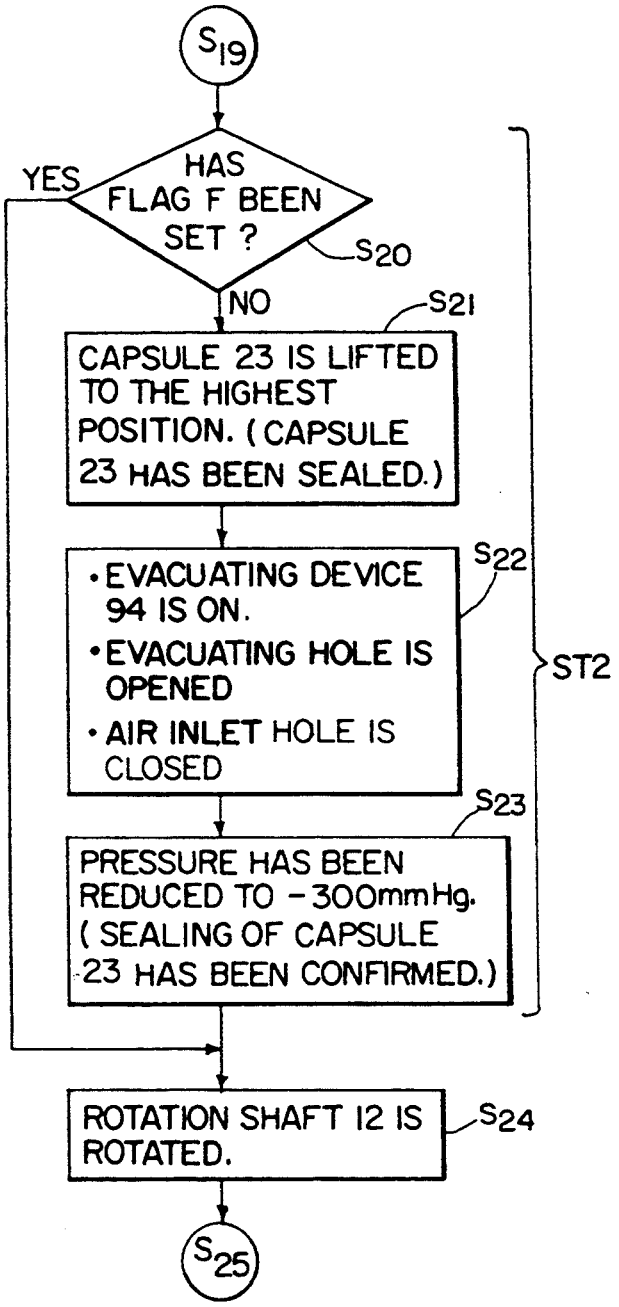

Referring to the flowchart in FIG. 15, at the work station ST2, whether a flag F has been set or not is checked to confirm that the bottle 81 has been placed on the table 24c (step S20). When the flag F has been set, i.e., the bottle 81 has not been placed on the table 24c, the subsequent steps of the operation at this work station ST2 are canceled. When no flag F has been set, the capsule 23 is lifted to the highest position where the top and thereof presses against the bottom end of the cover plate 22a, as is shown in FIG. 13B. Thus, the top end of the capsule 23 is closed airtightly with the cover plate 22a (step S21). Then, the lifting of the capsule 23 stops. To confirm that the capsule 23 has been closed airtightly, the open/close valve 93 is released to open the evacuating hole 22f so that the capsule 23 can be evacuated with the evacuating device 94. At the same time, the air inlet hole 22g is closed. Then, the evacuating device 94 is activated (step S22), and it is confirmed that the pressure inside the capsule 23 is reduced to −300 mmHg, for example (step S23). Since the toner inlet 81a of the bottle 81 placed in the capsule 23 is open, the inside of the bottle 81 is also evacuated when the capsule 23 is evacuated. When the sealing of the capsule 23 has been confirmed by the above steps, the rotation shaft 12 is rotated to turn the work unit 20 to the next work station ST3 (step S24).

Figure 13C:
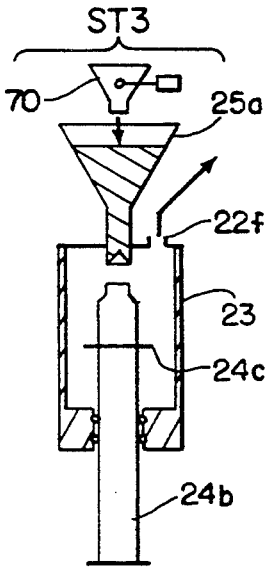
Figure 16:
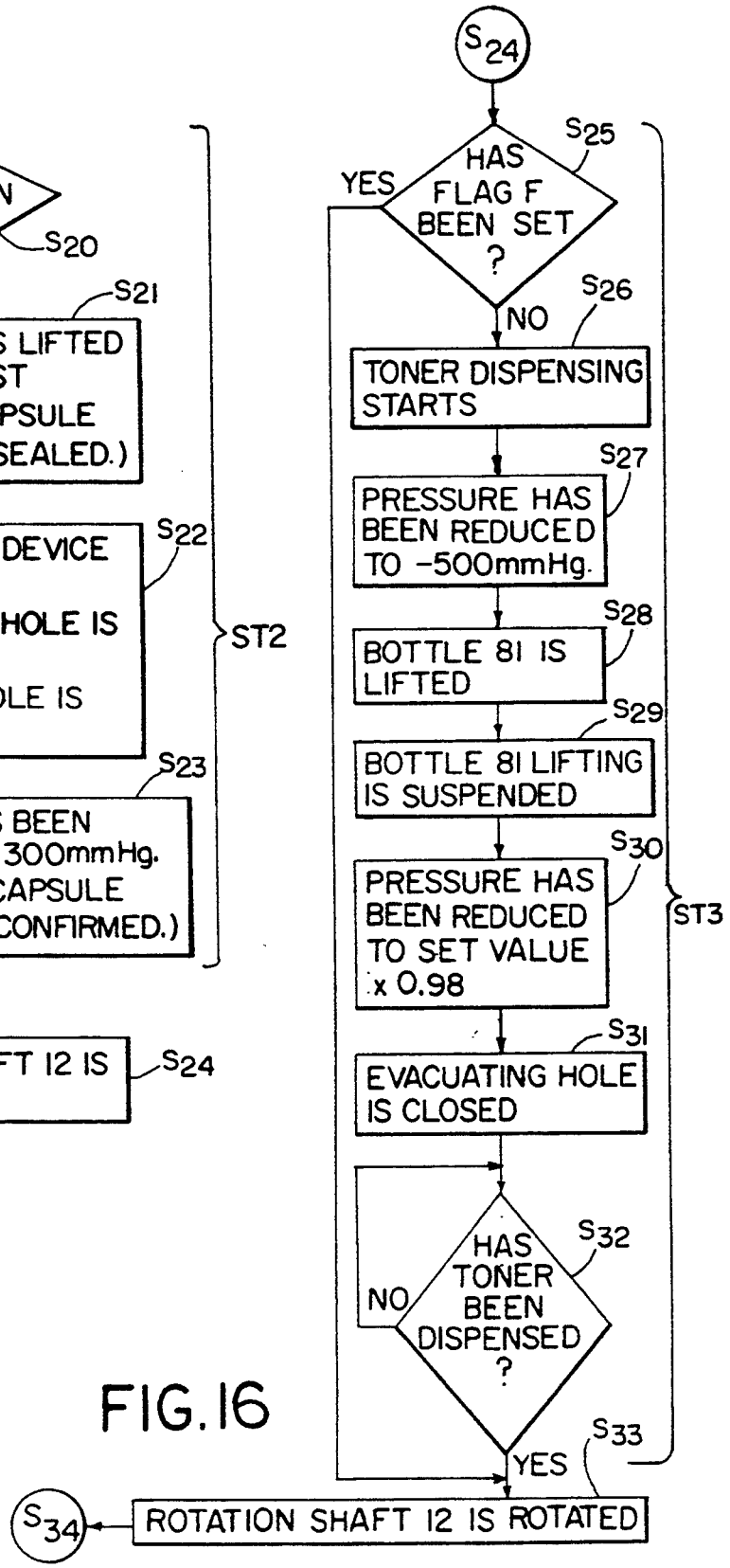

Referring to the flowchart in FIG. 16, at the work station ST3, as in the procedure at the work station ST2, whether a flag F has been set is checked to confirm that the bottle 81 has been placed on the table 24c (step S25). When the flag F has been set, i.e., the bottle 81 has not been placed on the table 24c, the subsequent steps of the operation at this work station ST3 are canceled. When no flag F has been set, a predetermined amount of toner is supplied to the toner feed mechanism 25 from the toner dispenser 70 disposed above the toner feed mechanism 25 (step S26), as is shown in FIG. 13C. At this the bottom opening of the nozzle 26 of the toner feed mechanism 25 has been closed with the valve element 27. The evacuation of the capsule 23 is being continued at this step. When the pressure inside the capsule 23 is lowered to −500 mmHg (step S27), the air cylinder 24s for lifting the table 24c is driven to lift the bottle 81 placed on the table 24c (step S28). The inside of the bottle 81 has also been evacuated at this evacuation. As the bottle 81 moves upward inside the capsule 23, the cover 24b covering the piston rod 24p of the air cylinder 24s gradually enters the capsule 23.

At this time, as the cover 24b gradually moves into the capsule 23, the evacuation degree in the capsule 23 changes. For this reason, when the toner inlet 81a of the bottle 81 reaches a predetermined position close to the nozzle 26, just before the toner inlet 81a is about to be fitted to the nozzle 26, the air cylinder 24s stops driving to suspend the lifting of the bottle 81 (step S29). Whether the bottle 81 has reached the predetermined position close to the nozzle 26 is detected by means of a photoelectric switch having a light emitting element and a light receiving element horizontally disposed on opposite sides across the transparent capsule 23. Thus, the bottle 81 is held at the predetermined position before being fitted to the nozzle 26.

When the lifting of the bottle 81 is suspended in the vicinity of the nozzle 26 as described above, a low air pressure is applied to the air cylinder 24s in the direction to lower the piston rod 24p. The extent of this air pressure is set to be balanced with a force applied upward to the table 24c produced due to the evacuation of the capsule 23, thus allowing the table 24c to stand still at the predetermined position.

The air pressure F to be applied to the air cylinder 24s in a direction to lower the piston rod 24p is set to satisfy the equation:

$$F = B \times (1(\mathrm{kg/cm^2}) \times (X/760))$$

wherein X is the degree of vacuum (−mmHg) when the atmospheric pressure is zero and B is the sectional area of the cover 24b ($cm^2$).

When the lifting of the bottle 81 has been suspended in the vicinity of the nozzle 26, and the capsule 23 and thus the bottle 81 are evacuated to the level of 98% of the set value (step S30), the open/close valve 93 is activated to close the evacuating hole 22f of the cover plate 22a, thereby to stop evacuating the capsule 23 (step S31). Then, when it is confirmed that the predetermined amount of toner has been supplied to the hopper 25a (step S32), the rotation shaft 12 is rotated to turn the work unit 20 to the next work station ST4 (step S33). At this time, the capsule 23 and the bottle 81 are kept under the evacuated condition.

Figure 13D:
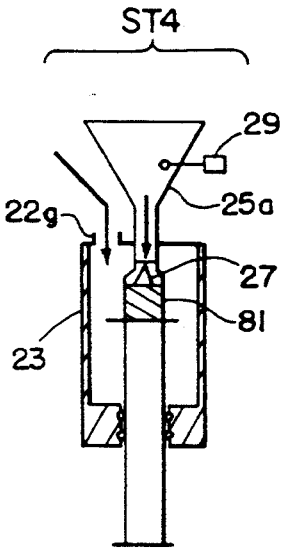
Figure 17:
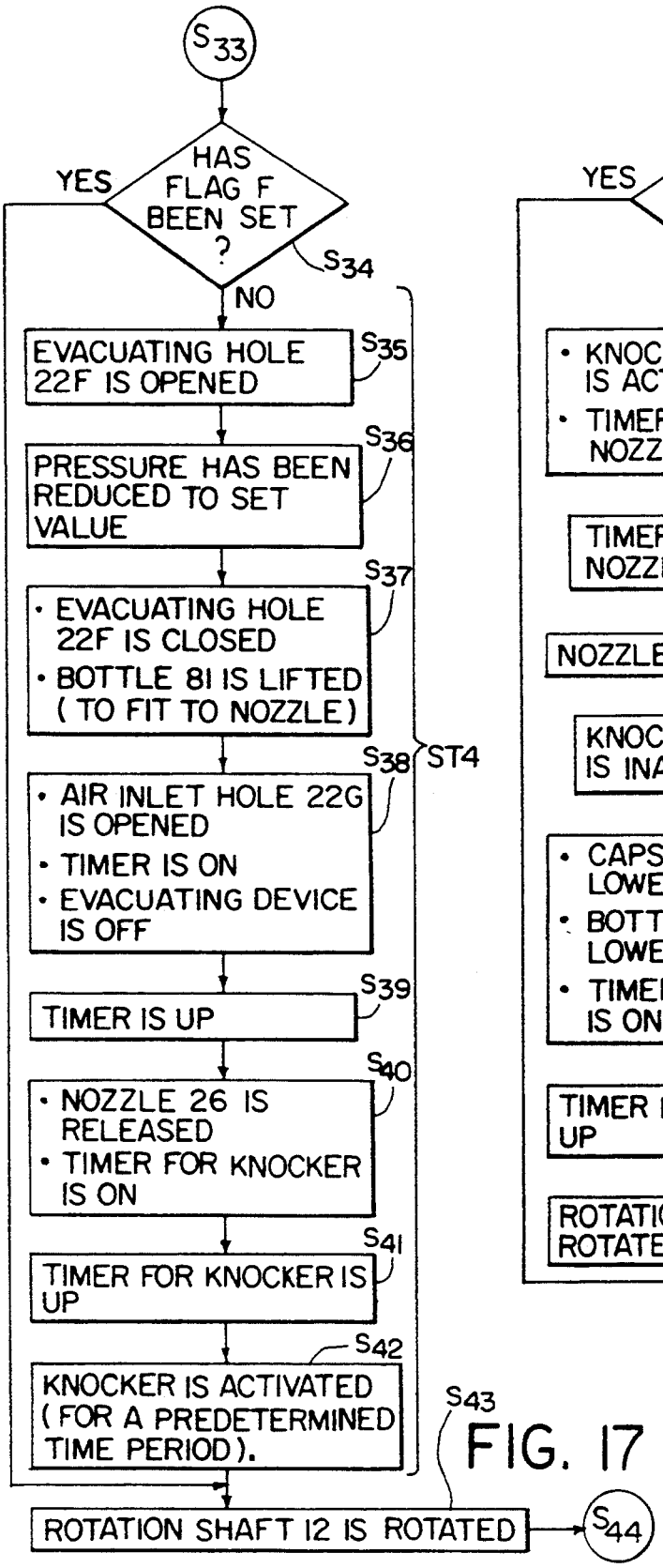

Referring to the flowchart in FIG. 17, at the work station ST4, whether a flag F has been set or not is checked to confirm that the bottle 81 has been placed on the table 24c (step S34). When no flag F has been set, the open/close valve 93 is released to open the evacuating hole 22f and thus to restart the evacuation of the capsule 23 (step S35), as is shown in FIG. 13D, until the pressure in the capsule 23 and the bottle 81 is reduced to the set value (step S36). At the work station ST3, the degree of the evacuation in the capsule 23 has changed due to the gradual movement of the cover 24b into the capsule 23 as the bottle 81 is lifted to the predetermined position. At this work station ST4, since the cover 24b has been almost lifted to its highest position, and the capsule 23 is further being evacuated to obtain the set reduced pressure, the capsule 23 can be precisely evacuated to the set value.

When the capsule 23 is evacuated to the set pressure, the open/close valve 93 is activated to close the evacuating hole 22f and thus to terminate the evacuation of the capsule 23. At the same time, the table 24c is further lifted so that the toner inlet 81a of the bottle 81 is fitted to the nozzle 26 (step S37). At this time, the valve element 27 closing the bottom opening of the nozzle 26 proceeds to the inside of the toner inlet 81a of the bottle 81 by the guidance of the tapered outer circumference 27g of the guide portion 27b of the valve element 27 so that the toner inlet 81a can be kept coaxially with the valve element 27. Then, the toner inlet 81a presses against the nozzle packing 26b attached to the nozzle 26 to complete the fitting to the nozzle 26.

When the above step is completed and the evacuating device 94 is inactivated, the air inlet hole 22g is opened, and a timer starts to count (step S38). When a predetermined time period has elapsed (step S39), the air cylinder 62 attached to the cover 25g of the hopper 25a is driven to lower the valve drive shaft 28 connected to the valve element 27. This also lowers the valve element 27 to release the bottom opening of the nozzle 26, causing the toner stored in the hopper 25a to drop, smoothly by being guided by the upper portion 28d of the straightening core 28c, to the nozzle 26 and then into the evacuated bottle 81 at high speed. When the toner drops through the lower narrow portion of the hopper 25a, the toner may be compressed, and as a result air contained in the toner may be blown upward. However, since such air flow can be guided by the lower portion 28e of the straightening core 28c to flow downward, the toner drops to the nozzle 26 smoothly without causing turbulence inside the hopper 25a (step S40).

The air inlet hole 22g of the cover plate 22a is opened a predetermined time period before the toner feeding to the bottle 81 starts. Accordingly, the difference of the pressure between the inside and the outside of the bottle 81 is reduced, preventing the bottle 81 from being broken due to the toner dropping inside the bottle 81 at high speed.

When dropping into the bottle 81, the toner collides against the buffer portion 27a of the valve element 27 located below the nozzle 26, and then flows down along the outer circumference of the buffer portion 27a. As a result, the speed of the toner dropping inside the bottle 81 is reduced, preventing the toner from violently colliding against the bottom of the bottle 81 and thus from being lumped in the bottle 81.

When the bottom opening of the nozzle 26 is released, the timer is set to count a predetermined time period for activating the knocker 29 disposed at this work station to strike the hopper 25a (step S40). When the predetermined time period has elapsed (step S41), the knocker 29 is activated to strike the hopper 25a for a predetermined time period (step S42) . This ensures that any toner staying in the hopper 25a drops into the bottle 81. Thereafter, the rotation shaft 12 is rotated to turn the work unit 20 to the next work station ST5 (step S43).

Figure 13E:
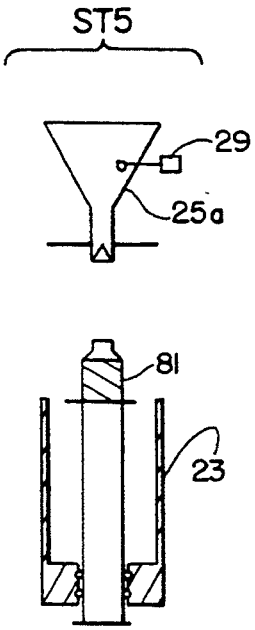
Figure 18:
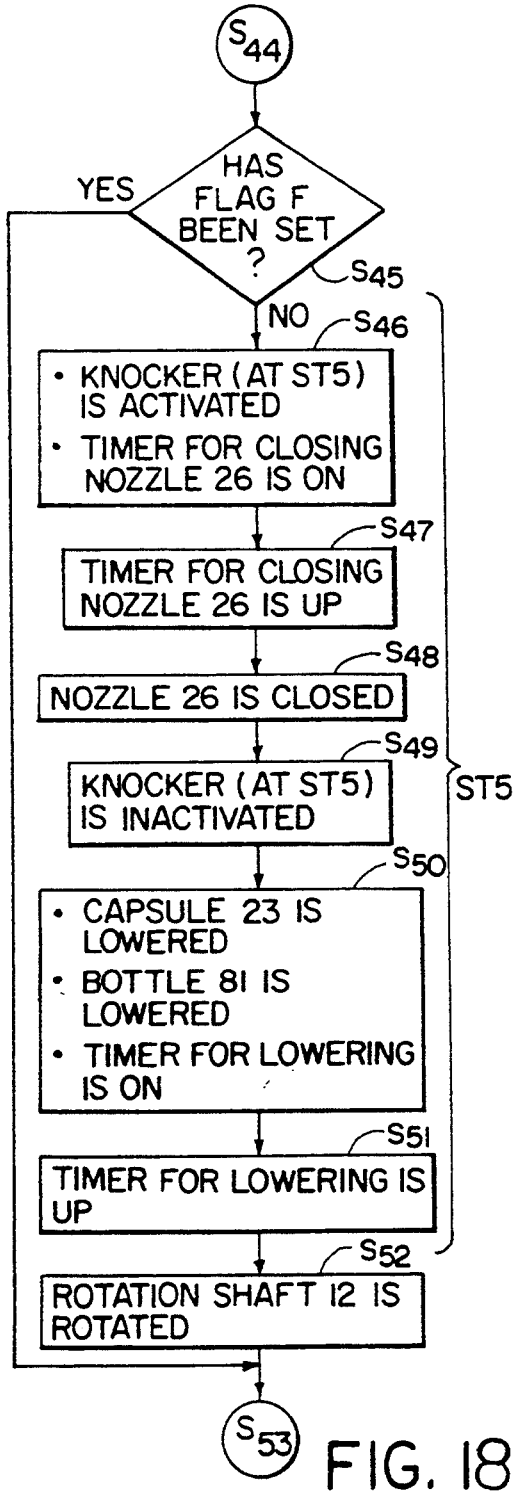

Referring to the flowchart in FIG. 18, at the work station ST5, whether a flag F has not been set is checked (step S45). When the bottle 81 has been placed on the table 24c, the knocker 29 disposed at this work station is activated to strike the hopper 25a, as is shown in FIG. 13E, and thus it is ensured that any toner staying in the hopper 25a drops into the bottle 81. At the same time, the timer starts to count a predetermined time period for closing the bottom opening of the nozzle 26 (step S46). The knocker 29 is activated to strike the hopper 25a. When the predetermined time period has elapsed (step S47), the valve element 27 is lifted to close the bottom opening of the nozzle 26 (step S48). At the same time, the knocker 29 is inactivated (step S49). Thereafter, both the table 24c with the bottle 81 thereon and the capsule 23 are lowered. The table 24c is lowered at high speed by the air cylinder 24s which is driven with high-pressure air at high speed. When the lowering of the bottle 81 and the capsule 23 starts, a timer starts to count a predetermined time period required for the lowering of the bottle 81 and the capsule 23 (step S50). When the predetermined time period has elapsed (step S51), the rotation shaft 12 is rotated to turn the work unit 20 to the last work station ST6 (step S52).

Figure 13F:
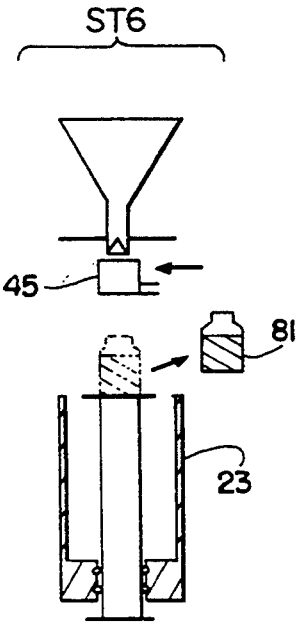
Figure 19:
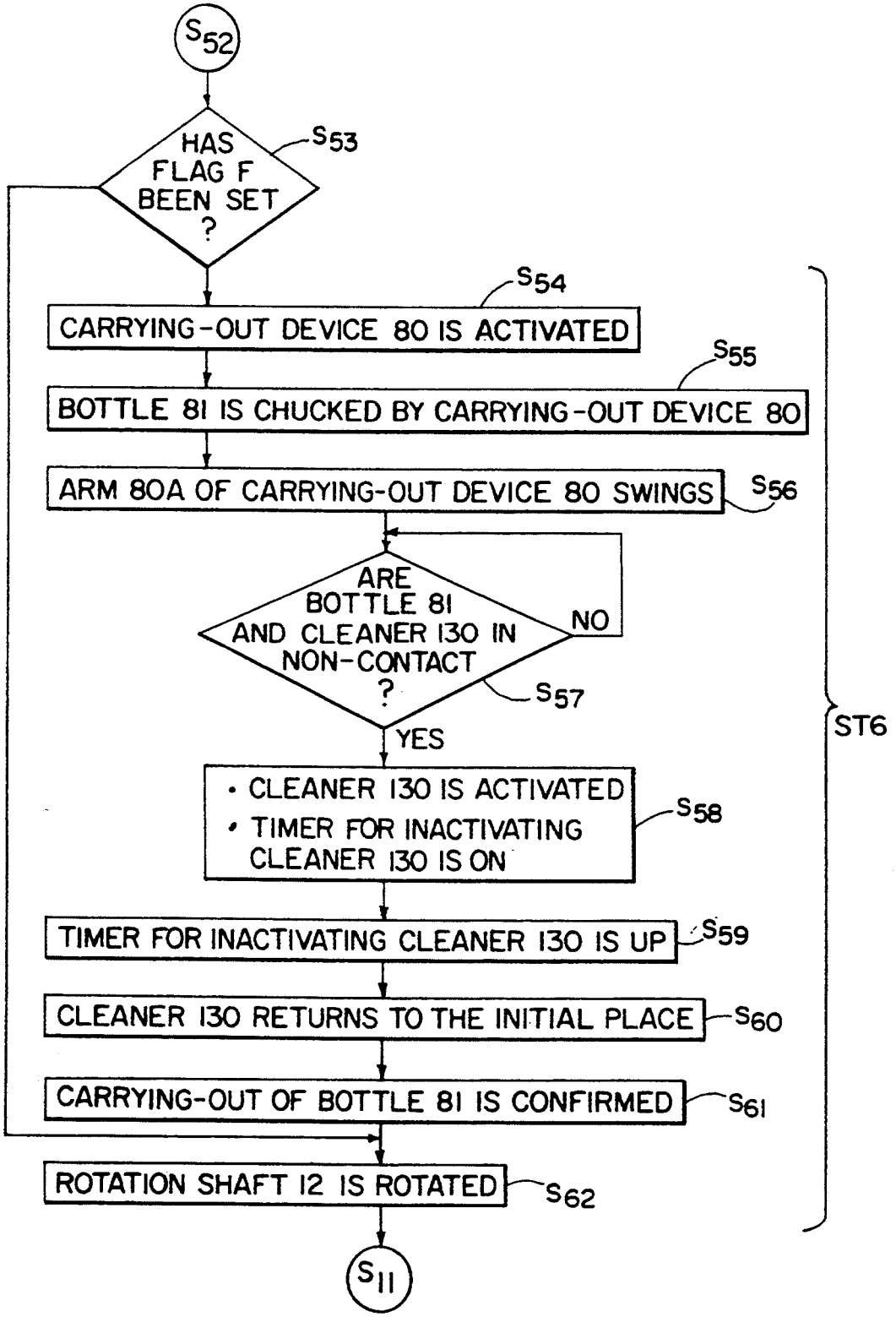

Referring to the flowchart in FIG. 19, at the work station ST6, whether a flag F has not been set is checked (step S53). When no flag F has been set, the carrying-out device 80 is activated (step S54), as is shown in FIG. 13F, and the bottle 81 filled with toner placed on the table 24c is chucked with the chucking claw 80b of the carrying-out device 80 (step S55) . Then, the arm 80a of the carrying-out device 80 swings (step S56). When it is confirmed that the cleaner 130 does not contact with the bottle 81 which has been removed from the area below the nozzle 26 (step S57), the cleaner 130 is activated to move to the area below the nozzle 26 and fixed to the nozzle 26. The inside of the cleaner 130 is then supplied with a vacuum to remove toner attached to the valve element 27 and the inner walls of the nozzle 26 and the hopper 25a. In this way, the cleaner 130 is disposed at a position not to interfere with the bottle 81 when the bottle 81 is taken out. This reduces the range where the cleaner 130 moves, and thus minimizes the size of the apparatus as a whole.

When the cleaner 130 is activated, a timer starts to count a predetermined time period (step S58). When the predetermined time period has elapsed (step S59), the cleaner 130 is released from the nozzle 26 and returns to its original place (step S60). When it is confirmed that the bottle 81 has been placed on the rotary table 91 of the transport-out conveyor 90 (step S61), the rotation shaft 12 is rotated to turn the work unit 20 to the first work station ST1 (step S62). The same operations as described above are repeated at the work stations ST1 to ST6 to fill another bottle 81 with toner.

As described above, according to the toner filling apparatus of the present invention, the work stations ST1 to ST6 are disposed at the same intervals in the circumferential direction. All the steps required for filling the container with toner with high density at high speed are performed at these stations ST1 to ST6. As a result, only a small space is required for the toner filling operation. Furthermore, since a plurality of steps are simultaneously performed at the respective work stations ST1 to ST6, the efficiency of the filling operation is remarkably high.

Figure 20:
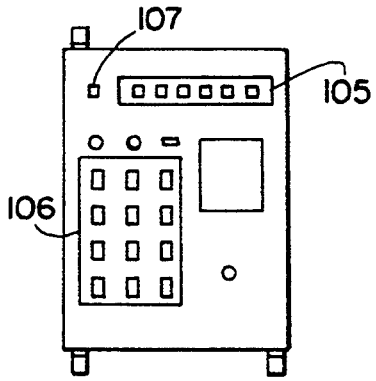
FIG. 20 is a plan view of a control board of the rotary filling device according to the present invention.

The toner filling apparatus according to the present invention can also be operated manually in an emergency such as when trouble occurs in feeding toner or with the maintenance of the apparatus. For manual operation, a control board is provided. Referring to FIG. 20, the control board includes a manual switch 107 and six selection switches 105 for activating the six work units 20, respectively. More than one of these selection switches 105 can be selected at one time. The control board also includes a plurality of instruction switches 106 for instructing a specific job to be performed by the work units 20. Accordingly, the work unit 20 selected by the selection switches 105 performs the specific job selected by the instruction switch 106. When more then one of the work units 20 are selected, the Job selected by the instruction switch 106 is performed at the selected work units 20 at the same time. Accordingly, using this control board, the manual operation during an emergency, the maintenance operation, or the like can be easily performed.

Figure 21:
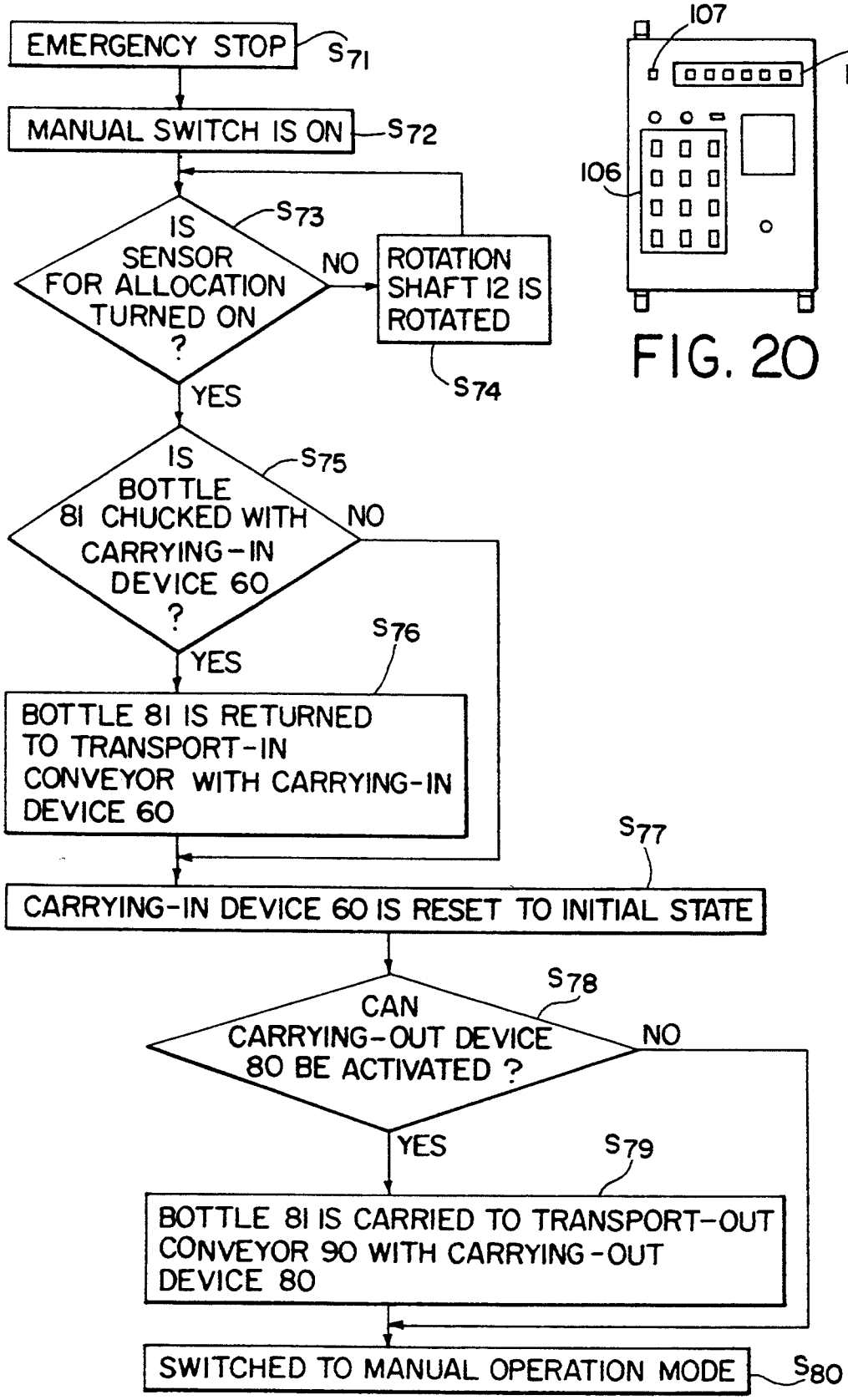
FIG. 21 is a flowchart showing the procedure during an emergency of the toner filling apparatus according to the present invention.

Referring to a flowchart in FIG. 21, the manual operation of the toner filling apparatus of the present invention will be described.

When an emergency occurs during the automatic toner filling operation, the rotary filling device 10 stops operating (step S71). When the manual switch 107 is turned on (step S72), whether any one of the work units 20 is placed on the predetermined position of the work station at that moment is detected by means of the sensor for allocation disposed at one of the work stations ST1 to ST6 as described earlier (step S73). When the work unit 20 is not placed on the predetermined position, the rotation shaft 12 of the rotary filling device 10 is rotated in the direction reverse to that at the normal filling operation until the sensor for allocation detects the presence of the work unit 20 at the predetermined position (step S74). By this step, the work units 20 are allocated to the nearby work stations ST1 to ST6, respectively.

Then, it is checked whether the bottle 81 has been chucked with the chucking claw 60*b* of the carrying-in device 60 (step S75). When the bottle 81 is being chucked with the chucking claw 60*b*, the bottle 81 is returned to the transport-in conveyor 50 (step S76). The carrying-in device 60 is then reset to its initial state (step S77), thereby stopping the carrying-in of the bottle 81 to the work unit 20.

Also, at the work station ST6, it is confirmed whether the carrying-out device 80 can be activated (step S78). If it can be activated, the carrying-out device 80 is driven to carry the bottle 81 filled with toner placed on the table 24*c* onto the transport-out conveyor 90 (step S79). When the series of steps described above terminates, the automatic operation of the toner filling apparatus is overridden, and the manual operation can be performed with the control board (step S80) .

As described above, when the automatic operation of the toner filling apparatus is discontinued and changed to manual operation during an emergency, the work units 20 may be on the way to the next work stations ST1 to ST6 after the completion of the operation at the previous work stations ST1 to ST6, respectively. In such a case, the work units 20 are returned to the previous work stations ST1 to ST6 at which the operation has been completed. Accordingly, in order to return the hopper 25*a*, for example, to the initial state before the automatic operation is restarted, toner left stored in the hopper 25*a* at the work stations ST3 and ST4 must be removed. This can be done at the work station ST5 by manually following all the steps required for feeding the toner to the bottle 81 by operating the instruction switches 106 on the control board.

When the capsule 23 of the work unit 20 has been evacuated at the emergency atop, air is introduced into the capsule 23 through the air inlet hole 22*g*. At this time, before air is introduced into the capsule 23, the open/close valve 93 is activated by the solenoid 93*c* to close the evacuating hole 22*f*, thereby to protect toner which has leaked into the capsule 23 from entering the cylinder 93*b* of the open/close valve 93 and the evacuating device 94. The air inlet hole 22*g* is opened only after it is confirmed that the valve element 93*a* of the open/close valve 93 has closed the evacuating hole 22*f*.

When, during an emergency stop, the work unit 20 is located at the work station ST4 and is in the step S38 shown in FIG. 17 where the air inlet hole 22*g* has been opened, the steps following the step S38 until the release of the nozzle 26 at the step S40 will be manually performed. As a result, the bottle 81 will be filled with toner, and thus, even when the operation for resuming the atmospheric pressure in the capsule 23 is delayed due to the emergency stop, troubles such as the breaking of the bottle 81 and the scattering of toner into the capsule 23 can be prevented.

Furthermore, according to the toner filling apparatus of the present invention, if any of the work units 20 has trouble in evacuating the capsule 23, other work units 20 can continue the automatic filling operation. This is accomplished by the procedure described below.

Figure 22:
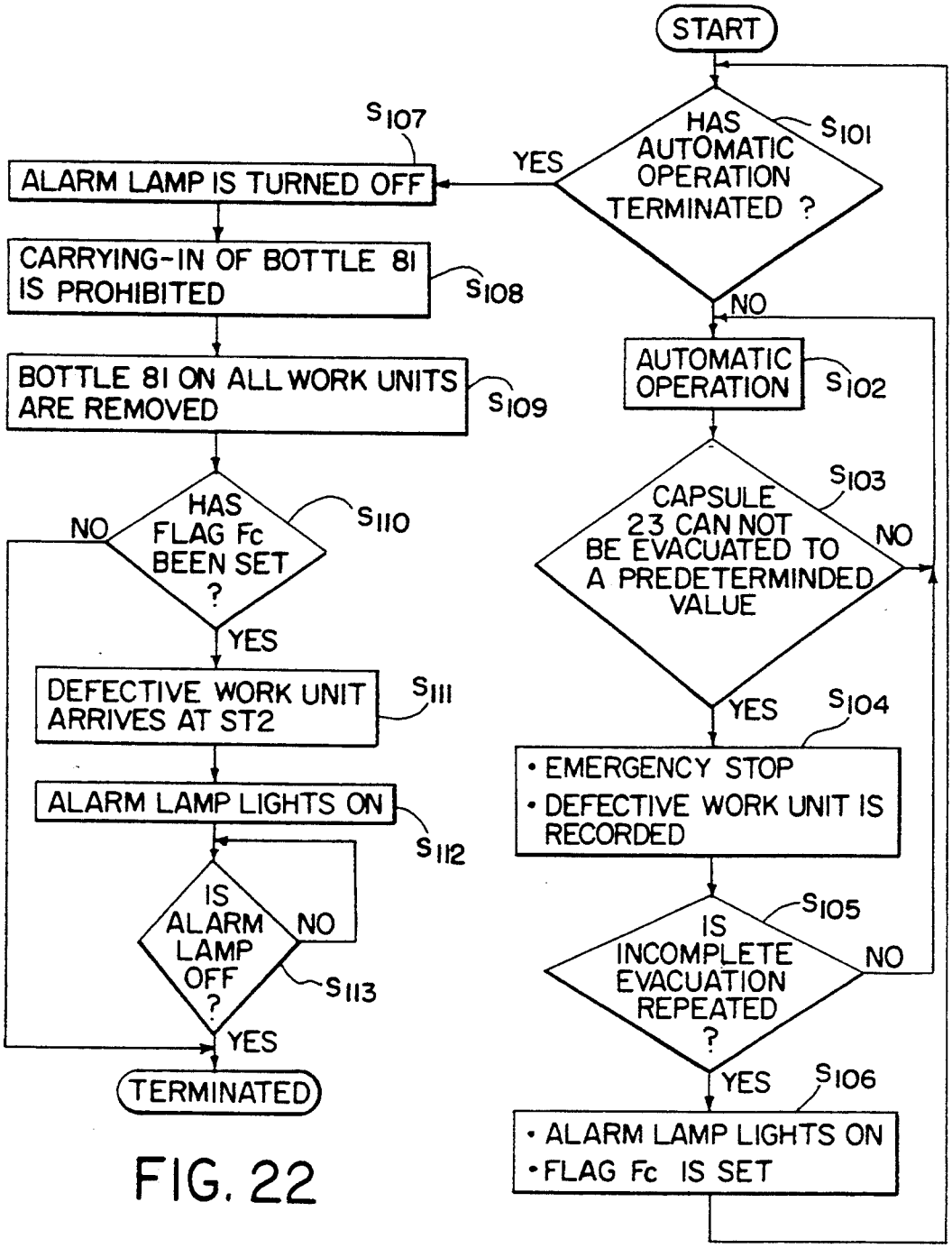
FIG. 22 is a flowchart showing the procedure followed when a capsule of one of the work units is not properly evacuated.

Referring to a flowchart in FIG. 22, at the automatic operation (step S102), when the pressure in the capsule 23 can not be reduced to a predetermined value at the work station ST2 at the step S23 in FIG. 15 (step S103), the work unit 20 having such a defective capsule 23 is recorded (step S104). Then, the capsule 23 of the recorded work unit 20 is rechecked as to whether the incomplete evacuation is repeated ( step S105 ). When the capsule 23 is normally evacuated at the second check, the automatic operation restarts. However, when the incomplete evacuation is repeated, a warning alarm lamp is lit on the control board, for example, and at the same time, a flag Fc is set (step S106).

When the automatic operation restarts under the conditions described above (step S106), the filling operation is not performed for the work unit 20 marked with the flag Fc at each of the work stations ST1 to ST6, as described earlier, though it is performed for the rest of the work units 20.

When the automatic operation terminates without restarting or after a normal automatic operation (step S101) , the alarm lamp is turned off (step S107), and the transport of the bottle 81 to the rotary filling device 10 is prohibited (step S108). Then, any bottle 81 placed on any work unit 20 is removed to the transport-out conveyor 90 (step S109). At this time, whether a flag Fc is set or not is checked (step S110). When no flag Fc is set, the operation is immediately terminated. When a flag Fc is set, the work units 20 are turned around the rotation shaft 12, though all bottles 81 on the work units 20 have been removed, until the work unit 20 having the defect capsule 23 arrives at the work station ST2 (step S111). At this time, the alarm lamp lights on again, warning that the work unit 20 present on the work station ST2 is defective (step S112). When the alarm lamp is turned off, the toner filling operation is terminated (step S113).

Figure 23:
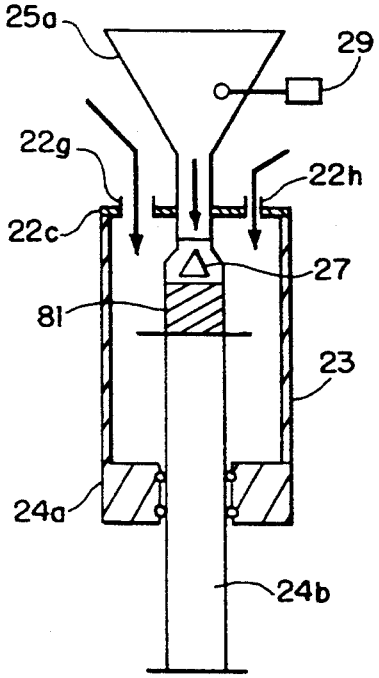
FIG. 23 is a schematic sectional view showing another cover plate of the work unit according to the present invention.

The present invention is not restricted to the above-described example, but many other alterations thereof are possible. For example, as is shown in FIG. 23, a small-size auxiliary air inlet hole 22*h* provided with an open/close valve attached thereto can be formed in the cover plate 22*a*, in addition to the air inlet hole 22*g*, for introducing air into the capsule 23 to resume the atmospheric pressure therein. The auxiliary air inlet hole 22*h* is used instead of the air inlet hole 22*g* for resuming the atmospheric pressure in the evacuated capsule 23 in case that the toner feeding operation would be stopped due to some cause. Because the auxiliary air inlet hole 22*h* has a small diameter, air is introduced into the capsule 23 at a lower speed, thereby the scattering of toner inside the capsule 23 is prevented. Alternatively, the air inlet hole 22*g* may have an open/close valve capable of adjusting the air flow so as to control the speed at which the atmospheric pressure is resumed in the capsule 23.

The following Examples 2 to 4 describe examples of the cleaner according to the present invention other then the above-described cleaner 130. In these examples, like components are denoted as like reference numerals, and the descriptions of such components are omitted.

EXAMPLE 2

Figure 24:
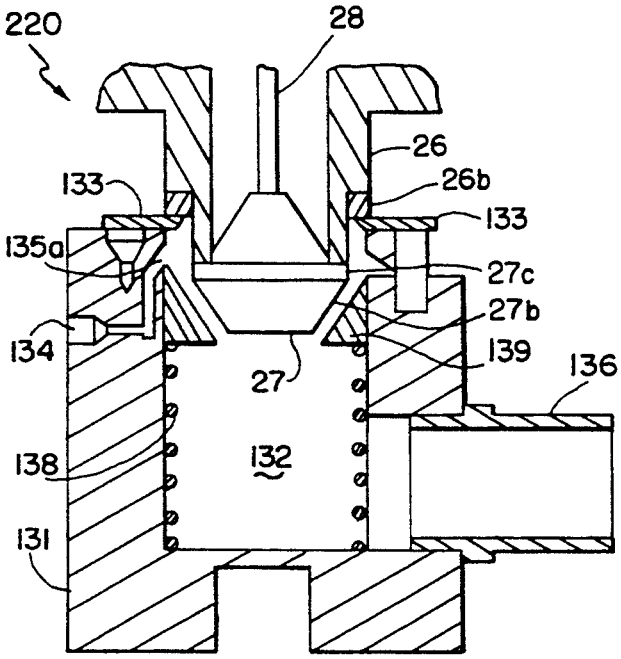
FIG. 24 is a sectional view of another cleaner according to the present invention.

Referring to FIG. 24, a cleaner 220 of this example includes the compressed air passage 134 having only one spurt outlet 135*a* open in an upward oblique direction. A ring straightening guide 139 is attached to the inner wall of the upper portion of the cleaner head 131 at such a position as to surround the guide portion 27*b* of the valve element 27. The straightening guide 139 has a slope corresponding to the tapered outer circumference of the guide portion 27*b* of the valve element 27. The straightening guide 139 is urged upward by a spring 138 to such a height that the top end of the straightening guide 139 does not extend over the spurt outlet 135*a*. At the top end, the straightening guide 139 is separated from the guide portion 27*b* by an appropriate distance.

The cleaning operation using the above-described cleaner is performed in the following manner. The valve element 27 is repeatedly lowered and lifted to open and close the bottom opening of the nozzle 26 under the condition that compressed air is being supplied through the compressed air passage 134. The compressed air spurted in an upward oblique direction collides against the bottom surface of the nozzle packing 26*b* attached to the nozzle 26 and then flows down along the outer circumference of the nozzle 26. When the valve element 27 is lowered to open the bottom opening of the nozzle 26, the packing 27*c* of the valve element 27 is released from the bottom end of the nozzle 26 and the straightening guide 139 is pressed downward by the valve element 27. This results in that the compressed air flows to the top surface of the packing 27*c* to remove the toner attached thereto. When the valve element 27 is lifted to close the bottom opening of the nozzle 26, the compressed air flows down between the guide portion 27*b* of the valve element 27 and the straightening guide 139, allowing the toner attached to the outer circumference of the valve element 27 to be removed. After lowered and lifted repeatedly for a predetermined time period, the valve element 27 is finally lifted to close the bottom opening of the nozzle 26. Under this condition, the nozzle 26 and the valve element 27 are cleaned with the compressed air for another predetermined time period.

EXAMPLE 3

Figure 25:
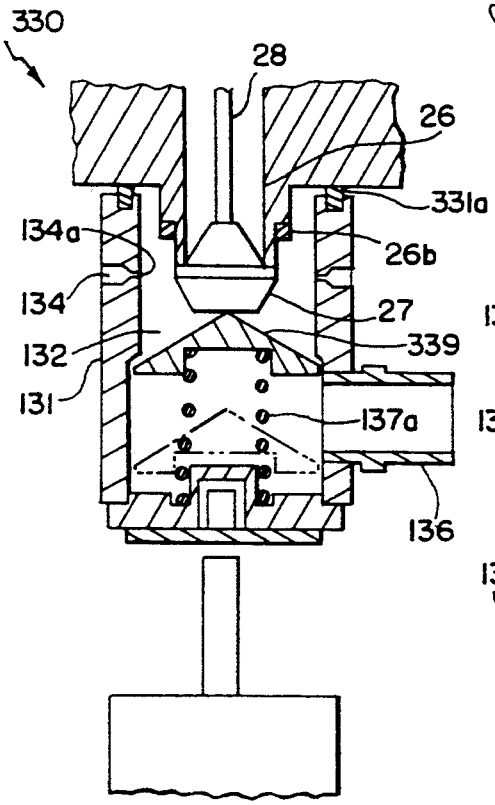
FIG. 25 is a sectional view of yet another cleaner according to the present invention.

Referring to FIG. 25, a cleaner 330 of this example includes the cylindrical cleaner head 131. The cleaner head 131 does not contact with the nozzle packing 26*b* as in the previous examples, but encloses the nozzle 26 and the valve element 27 at a position having an appropriate distance therefrom. A packing 331*a* is attached to the top end of the cleaner head 131 so as to press against the flange portion of the nozzle 26. A vertically slidable cover 339 is disposed in the lower portion of the cleaner head 131. The cover 339 is urged upward with a spring 137*a* so that it can airtightly slide along the inner circumference of the cleaner head 131. By the upward force of the spring 137*a*, the cover 339 is normally positioned above an opening formed in the lower portion of the cleaner head 131 for the communication of the cleaning chamber 132 with the exhaust passage 136. A plurality of compressed air passages 134 are formed on the outer circumference of the upper portion of the cleaner head 131, extending horizontally through the wall of the cleaner head 131. The inner end of each compressed air passage 134 has the spurt outlet 134*a* facing the packing 27*c* of the valve element 27.

When the cleaner head 131 of this example is attached to the nozzle 26 to enclose the nozzle 26 and the valve element 27 therein, the cover 339 is pressed downward with the valve element 27 against the urging force of the spring 137*a* to the position shown by the two-dot dash line in FIG. 25. This allows the cleaning chamber 132 to be communicated with the exhaust passage 136. Thus, according to the cleaner 330 of this example, only when compressed air is spurted from the spurt outlet 134*a*, the cleaning chamber 132 is communicated with the exhaust passage 136 to discharge toner and the like together with the air through the air exhaust passage 136. Thus, wasteful use of a dust collector can be avoided, thereby saving energy.

EXAMPLE 4

Figure 26:
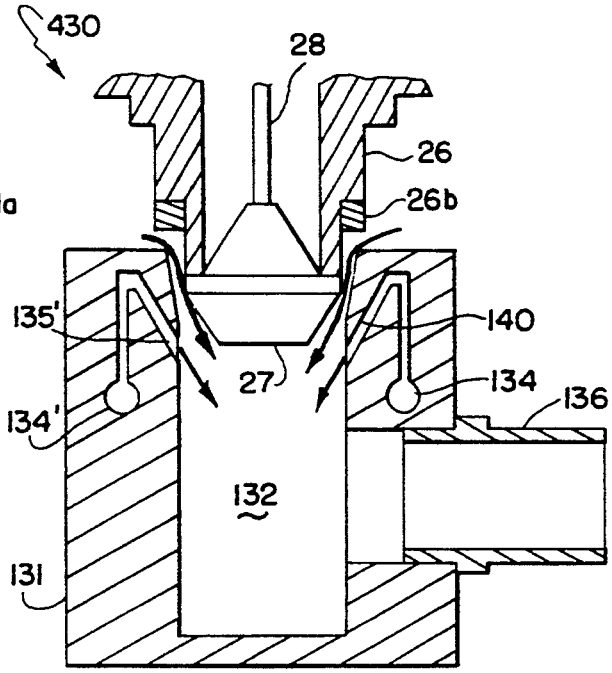
FIG. 26 is a sectional view of still yet another cleaner according to the present invention.

Referring to FIG. 26, a cleaner 430 of this example includes a compressed air passage 134' formed circularly in the wall of the cleaner head 131. A plurality of branch passages 135' extend right upward from the compressed air passage 134' and then bends in a downward oblique direction so that the compressed air can be spurted in the downward oblique direction into the cleaning chamber 132.

The cleaner 430 having the above-described structure does not press against the nozzle packing 26*b* of the nozzle 26, but a gap is formed between the top end of the cleaner 430 and the nozzle packing 26*b*. Under this condition, compressed air is supplied to the compressed air passage 134' to be spurted from the spurted outlets of the branch passages 135'. This air spurt causes air flow through the gap between the top end of the cleaner 430 and the nozzle packing 26*b* from outside. By this air flow, toner attaching to the outer circumferences of the nozzle 26 and the valve element 27 can be removed.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A powder filling apparatus, comprising:

a rotary filling device for filling a container with powder, including a plurality of work units arranged to move around along the same circumference, wherein a container is carried into each of said work units during the movement of the work units, both the inside and the outside of the container are equally evacuated, and powder is dropped into the container while the pressure outside the container is raised;

a carrying-in device for carrying a container into each of said work units moving around successively;

a powder dispenser for dispensing and supplying a predetermined amount of powder to each of said work units moving around successively; and a carrying-out device for carrying the container filled with powder from each of the work units successively during the moving around of said work units, wherein each of said work units includes:

a hopper for storing a predetermined amount of powder required for filling the container dispensed and supplied thereto;

a nozzle portion having a bottom opening, said nozzle portion being connected to the bottom end of said hopper for allowing the powder stored in said hopper to drop through said bottom opening;

a valve element vertically movable relative to said nozzle portion, said valve element fitting into said bottom opening of said nozzle portion to close said opening when lifted, and to release said opening when lowered;

a valve drive shaft with said valve element attached to the bottom end thereof, said valve drive shaft extending through the axial centers of said hopper and said nozzle portion slidably in the vertical direction;

a table vertically moveable relative to the nozzle portion, said table receiving the container placed thereon with a powder inlet of the container facing upward, wherein said powder inlet of the container is fitted to said nozzle portion when said table is lifted;

a cylindrical capsule vertically movable relative to said nozzle portion, said capsule surrounding said nozzle portion and said container placed on said table when said capsule is lifted;

a capsule lifting mechanism disposed outside said capsule for driving the lifting and lowering of said capsule;

a cover plate effecting an airtight contact with the top end of said capsule when said capsule is lifted so that the inside of the capsule is evacuated; and a table lifting mechanism disposed below said capsule when said capsule is lifted and sealed, for lifting and lowering said table inside said capsule while keeping the airtight condition of said capsule.

2. A powder filling apparatus according to claim 1, wherein said table lifting mechanism includes:

a means for lifting said table in the evacuated capsule up to a position where the powder inlet of the container is close to the bottom opening of said nozzle portion;

a means for suspending the lifting of said table at the position; and a means for lifting said table from the position to a position where said powder inlet is fitted to said nozzle portion.

3. A powder filling apparatus according to claim 2, wherein said table lifting mechanism further includes:

an air cylinder standing vertically including a piston rod, said piston rod being attached to said table at the top end thereof; and a cylindrical cover member covering said air cylinder and fixed to said air cylinder so as to be lifted integrally with said table, said cover member being slidable along the airtight bottom end of the capsule in an airtight condition.

4. A powder filling apparatus according to claim 3, wherein in said air cylinder the air pressure for lifting said table is set lower than the air pressure for lowering said table.

5. A powder filling apparatus according to claim 3, wherein said air cylinder includes a means for applying air pressure for driving said table downward when said table is suspended in said evacuated capsule.

6. A powder filling apparatus according to claim 1, wherein said container is carried into each of said work units with said carrying-in device, the bottom end of said container being supported by a retainer with the powder inlet of the container facing upward, said retainer having a recess on the bottom surface thereof, and said table of each of said work units has a protrusion thereon so as to be fitted into said recess formed on the bottom face of the retainer.

7. A powder filling apparatus according to claim 1, wherein the table includes a wall portion protruding upward around the periphery thereof.

8. A powder filling apparatus according to claim 1, wherein the capsule lifting mechanism includes:

an air cylinder disposed vertically on the side of said capsule;

a horizontal support plate fixed to the air cylinder; and a capsule support disposed on said support plate for supporting the bottom end of the capsule airtightly.

9. A powder filling apparatus according to claim 1, wherein the powder is a toner.

10. A powder filling apparatus, comprising:

a rotary filling device for filling a container with powder, including a plurality of work units arranged to move around along the same circumference, wherein a container is carried into each of said work units during the movement of the work units, both the inside and the outside of the container are equally evacuate, and powder is dropped into the container while the pressure outside the container is raised;

a carrying-in device for carrying a container into each of said work units moving around successively;

a powder dispenser for dispensing and supplying a predetermined amount of powder to each of said work units moving around successively; and a carrying-out device for carrying the container filled with powder from each of the work units successively during the moving around to said work units, wherein each of said work units includes:

a hopper for storing a predetermined amount of powder required for filling the container dispensed and supplied thereto;

a nozzle portion having a bottom opening, said nozzle portion being connected to the bottom end of said hopper for allowing the powder stored in said hopper to drop through said bottom opening;

a valve element vertically movable relative to said nozzle portion, said valve element fitting into said bottom opening of said nozzle portion to close said opening when lifted, and to release said opening when lowered; and a valve drive shaft with said valve element attached to the bottom end thereof, said valve drive shaft extending through the axial centers of said hopper and said nozzle portion slidably in the vertical direction; and wherein said valve element includes:

a buffer portion forming an upper part of said valve element having a truncated-cone shape tapered upward to that powder dropping from said nozzle portion collides against the outer circumference of said buffer portion; and a guide portion forming a lower part of said valve element having a truncated-cone shape tapered downward so that said powder inlet of the container can be guided through the outer circumference of said guide portion.

11. A powder filling apparatus according to claim 10, wherein the powder is a toner.

* * * * *

UNITED STATES PATENT AND TRADEMARK OFFICE

CERTIFICATE OF CORRECTION

PATENT NO. : 5,337,794

DATED : August 16, 1994

INVENTOR(S) : Shigeru Nishiyama et al.

It is certified that error appears in the above-indentified patent and that said Letters Patent is hereby corrected as shown below:

Column 1, line 33, change "set%led" to --settled--.

Claim 10, column 26, line 23, change "evacuate" to --evacuated--.

Claim 10, column 26, line 34, change "to" to --of--.

Signed and Sealed this

Sixth Day of December, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,337,794

DATED : August 16, 1994

INVENTOR(S) : Shigeru Nishiyama et al.

It is certified that error appears in the above-indentified patent and that said Letters Patent is hereby corrected as shown below:

On the title page: Item

-- [30] Foreign Application Priority Data

| | | | |
|---|---|---|---|
| Feb. 20, 1992 | [JP] | Japan | 4-33718 |
| Feb. 20, 1992 | [JP] | Japan | 4-33719 |
| Feb. 20, 1992 | [JP] | Japan | 4-33720 |
| Feb. 20, 1992 | [JP] | Japan | 4-33721 |
| Feb. 20, 1992 | [JP] | Japan | 4-33723 --. |

Signed and Sealed this

Tenth Day of January, 1995

*Attest:*

Bruce Lehman

BRUCE LEHMAN

*Attesting Officer*

*Commissioner of Patents and Trademarks*